United States Patent [19]

Fleming

[11] Patent Number: 4,663,020

[45] Date of Patent: May 5, 1987

[54] MULTIZONE NAPHTHA REFORMING PROCESS

[75] Inventor: Bruce A. Fleming, Chicago, Ill.

[73] Assignee: Amoco Corporation, Chicago, Ill.

[21] Appl. No.: 832,165

[22] Filed: Feb. 21, 1986

[51] Int. Cl.[4] ..... C10G 35/06

[52] U.S. Cl. ..... 208/65

[58] Field of Search ..... 208/65

[56] References Cited

U.S. PATENT DOCUMENTS 4,588,495 5/1986 Franck et al. ..... 208/65

*Primary Examiner*—Curtis R. Davis

*Attorney, Agent, or Firm*—Robert E. Sloat; William H. Magidson; Ralph C. Medhurst

[57] ABSTRACT

A catalytic reforming process is disclosed for converting naphtha hydrocarbons to higher octane products through an improved process which comprises contacting a hydrocarbon in a first zone with a first catalyst comprising tin and at least one platinum group metal deposited on a solid catalyst support followed by subsequent contacting in a second zone with a second catalyst comprising at least one platinum group metal deposited on a solid catalyst support.

21 Claims, 5 Drawing Figures

MULTIZONE NAPHTHA REFORMING PROCESS

BACKGROUND OF THE INVENTION (1) Field of the Invention

This invention is related to the conversion of hydrocarbon streams using a catalytic reforming multizone process and more particularly to catalytic reforming of naphtha fractions over a first catalyst containing tin and a platinum group metal followed by contacting with a second catalyst containing a platinum group metal.

(2) General Background

The reforming of hydrocarbon naphtha streams is an important petroleum refining process employed to provide high octane hydrocarbon blending components for gasoline or chemical processing feedstocks.

Catalytic reforming of naphthas can be carried out through the use of several types of catalysts and in fixed or moving bed processes. Catalysts employing a platinum group metal as a hydrogenation component and rhenium as a promoter are often employed in reforming processes.

Within the last ten years many companies have promoted the use of catalysts which contain additional components to enhance the catalytic properties of reforming catalysts. One of these components which is used commercially is tin. Typically, tin is placed on an alumina support making up a reforming catalyst containing platinum and optionally rhenium.

It is known that a platinum-tin reforming catalyst generally gives a higher $C_5+$ yield at constant conversion as measured by octane number than platinum-rhenium catalysts or catalyst containing just platinum. Furthermore, platinum-tin catalysts are more stable than platinum catalysts and less stable than platinum-rhenium catalysts.

In pilot plant tests using identical feedstocks and different catalysts, these results were confirmed. The platinum-tin catalyst did show increased $C_5+$ yields when compared to a standard commercially available platinum-rhenium catalyst while the platinum-rhenium catalyst showed greater stability than the platinum-tin catalyst. In an experiment, which will be described in detail later, a mixed loading test was performed in which a platinum-tin catalyst was used in the initial two of three reaction zones of the pilot unit followed by a platinum catalyst in the last reaction zone. The selectivity exhibited by this mixture of catalysts surprisingly showed that benzene, toluene and xylene (BTX) yields with the mixed catalyst loading were greater than with either catalyst when tested independently.

I have found in the early part of the reaction train where dehydrocyclization is predominant, high yields of heavy aromatics are produced by the platinum-tin catalyst which possesses a higher paraffin dehydrocyclization selectivity. These heavy aromatics are dealkylated to BTX by the platinum or platinum-rhenium catalyst in the latter stages of the reaction train where the hydrocracking reaction is predominant. There is no need for the tin containing catalyst to be present in the latter zones of a multizone reforming process, since the predominant reaction taking place there is hydrocracking. I have also found that platinum-rhenium catalysts are more stable than platinum-tin catalysts which makes the former a better choice for use in the latter stages of a multizone reforming process where catalyst deactivation is typically greater.

An advantage, therefore, exists in a reforming process having at least two segregated catalyst zones where the first zone contains a first catalyst containing tin and at least one platinum group metal (e.g., tin and platinum). The second zone contains a second catalyst containing at least one platinum group metal (e.g., platinum, preferably platinum and rhenium) and preferably has an essential absence of tin.

This means the second catalyst should contain low amounts of tin, since the preferred second catalyst is platinum-rhenium which is more stable than a tin-containing catalyst in the latter stages of a reforming process. An essential absence of tin generally means concentrations of tin of less than about 0.1 weight percent of the catalyst and preferably less than about 0.05 weight percent. Tin can be present in minor amounts in the second catalyst through various sources, such as contamination in manufacture or contact with equipment, such as reactors or catalyst loading equipment, or from tin carry-over from upstream catalysts or equipment.

The improved BTX yields are of considerable economic importance, and furthermore, the BTX yield improvement is not at the expense of the $C_5+$ yield which also increased. Thus, the advantages in improved quality of liquid product are not accompanied by a reduction in overall liquid product and, in cases where platinum-rhenium catalysts are used in the latter reaction stages, overall catalyst activity can be more easily obtained.

It can be seen that the application of this invention, therefore, leads to improved profitability of reforming operations in that liquid yields and especially the valuable BTX segment is increased. Further, since more active platinum-rhenium catalysts can be used in the latter stages of a multi-stage reforming process where improved catalyst stability results in higher octane numbers, this invention does not detract significantly from ability to meet expected future requirements for higher reformate octanes which will be required in many refineries.

Stone, U.S. Pat. No. 3,864,240 discloses a two-stage reforming process in which a fixed-bed comprises the first reaction zone and one or more moving beds comprise the second reaction zone in the process. The catalyst used in such a process can be a Group VIII noble metal combined with a halogen component placed on a porous carrier material which may contain various modifiers including rhenium and tin.

In U.S. Pat. No. 4,212,727, Antos, a single-stage reforming process is disclosed employing a commingled physical catalyst mixture of a first catalytic composite comprising palladium on a zeolite aluminosilicate carrier material and a second catalytic composite comprising alumina, platinum, and a platinum promoter including tin.

In U.S. Pat. No. 4,032,475, Knapik et al., a catalyst and process are disclosed for the reforming of hydrocarbons in which the catalyst system comprises a physical mixture of particles made up of platinum group metals, tin, halogen and cobalt mixed with dual-function catalysts of the prior art typically containing platinum and rhenium.

In European Pat. No. 153,891 issued Sept. 4, 1985, corresponding to U.S. Pat. No. 4,588,495 issued May 13, 1986, based on French Application No. 842926 filed Feb. 23, 1984, there is disclosed a reforming process giving high quality gasoline with good catalyst stability which employs a platinum-rhenium catalyst in the first bed of a multi-stage reaction process followed by one or more beds of a catalyst comprising platinum, and tin, thallium or indium. It should be noted that in this patent the teaching of a mixed catalyst system requires the platinum and tin composite be in the latter stages of the reforming process.

In U.S. Pat. No. 3,705,095, Dalson et al., a two-stage reforming process is disclosed comprising a naphthene dehydrogenation zone having a catalyst containing platinum and having an essential absence of rhenium followed by a paraffin dehydrocyclization zone having a catalyst obtaining platinum and rhenium.

SUMMARY

The present invention can be summarized as a catalytic reforming process for conversion of hydrocarbons which process has at least two separate catalyst zones and wherein an improvement comprises contacting the hydrocarbon stream in a first zone with a first catalyst comprising tin and at least one platinum group metal deposited on a solid catalytic support followed by contacting of at least a portion of the hydrocarbon stream in a second zone with a second catalyst comprising at least one platinum group metal deposited on a solid catalytic support. Rhenium is an optional component of the second catalyst. In a preferred instance the catalyst in the second zone contains an essential absence of tin.

It is an object of the present invention to provide a multizone catalytic reforming process having increased yields of benzene, toluene and xylenes while also maintaining improved $C_5+$ yields.

It is another object of the present invention to provide a multizone reforming process in which a first reforming catalyst comprising tin and at least one platinum group metal in combination with a second reforming catalyst comprising at least one platinum group metal give higher benzene, toluene and xylene yields than either catalyst provides alone and higher overall $C_5+$ yields than tin-free reforming catalyst systems provide.

BRIEF DESCRIPTION OF THE DRAWINGS

FIG. 1 shows the $C_5+$ liquid yield in weight percent versus $C_5+$ research octane for the two runs of single loads of Catalysts A and B (Examples I and II) and the invention which comprises the split loading of Catalysts A and C (Example III).

FIG. 2 shows the benzene yield versus $C_5+$ research octane for the same three Examples.

FIG. 3 shows the toluene yield versus $C_5+$ research octane for the same Examples.

FIG. 4 shows the $C_8$ aromatics (xylenes plus ethylbenzene) yield versus $C_5+$ research octane for the three Examples.

FIG. 5 shows the overall $C_9+$ aromatics yield versus the $C_5+$ research octane for the three Examples.

It should be noted that the data shown in the Figures are based on experiments performed as described in the Examples. The two lines in each Figure represent the 95 percent confidence interval for the runs using Catalyst B. The 95 percent confidence interval is placed on all the Figures to show where there is a statistically significant variance in the data generated from the Examples. The 95 percent confidence interval is well known in the art to those familiar with statistical treatment of experimental data.

In each of the Figures, there are nine reported data points which should be disregarded for the purposes of illustrating the improved results obtained by practicing the claimed invention. Specifically, the three x's and six +'s which are within the dotted lines on each Figure represent data obtained when the catalyst being tested exhibited low relative activity primarily due to excess coke lay down on the catalyst which has an adverse influence on the catalyst performance. The yields represented during these periods of testing do not, therefore, reflect the correct relationship between octane and the particular yield in question. These data are reported for completeness only.

It should be noted that the low relative activity periods for the two Examples affected are all at end of run conditions which is not unusual. In Example I, test periods 19, 21 and 24, and in Example III, test periods 15, 16, 17, 18, 19 and 20, are the periods of low relative catalyst activity.

In general, the low relative activity of a catalyst is determined by observing the calculated selectivity of a catalyst over a period of time. When a major downward selectivity trend occurs, indicating that coke lay down in the catalyst is having an adverse effect, low relative activity is determined.

Figure 1:
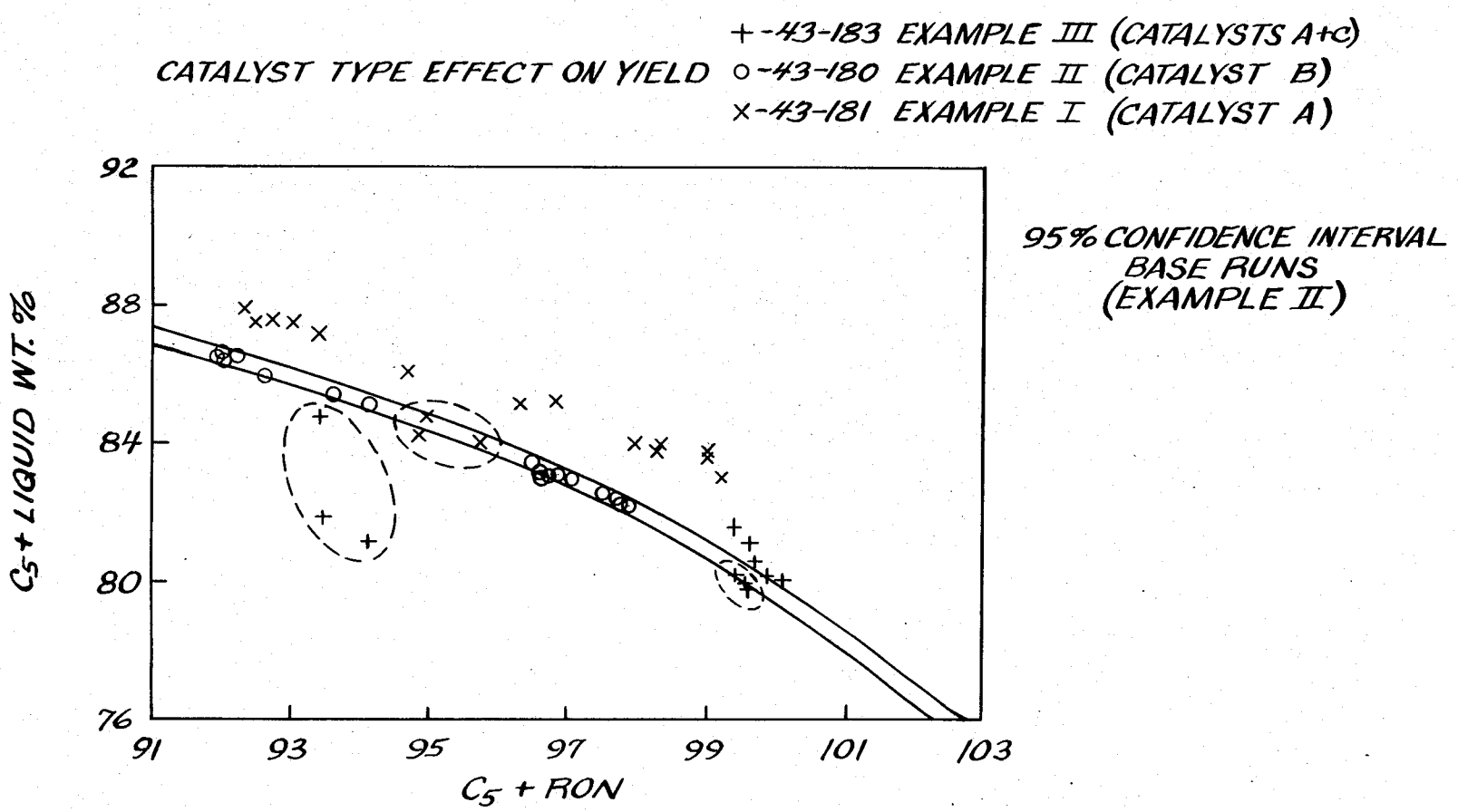
FIGS. 1 through 5 show comparisons between various measured yield parameters for three different pilot plant experiments described in the Examples. The x's on all of the Figures represent the data generated in Example I using Catalyst A which was a commercially available platinum-tin on alumina reforming catalyst. The circles represent the data generated in Example II using Catalyst B which was a commercially available platinum-rhenium on alumina reforming catalyst. The +'s on all the Figures represent the data generated in Example III which used a split loading which comprised Catalyst A followed by Catalyst C. Catalyst C was a commercially available platinum on alumina reforming catalyst. Catalysts B and C can be validly compared when measuring product yields since the function of rhenium on the catalyst is to promote coke tolerance rather than to affect yields.
Figure 2:
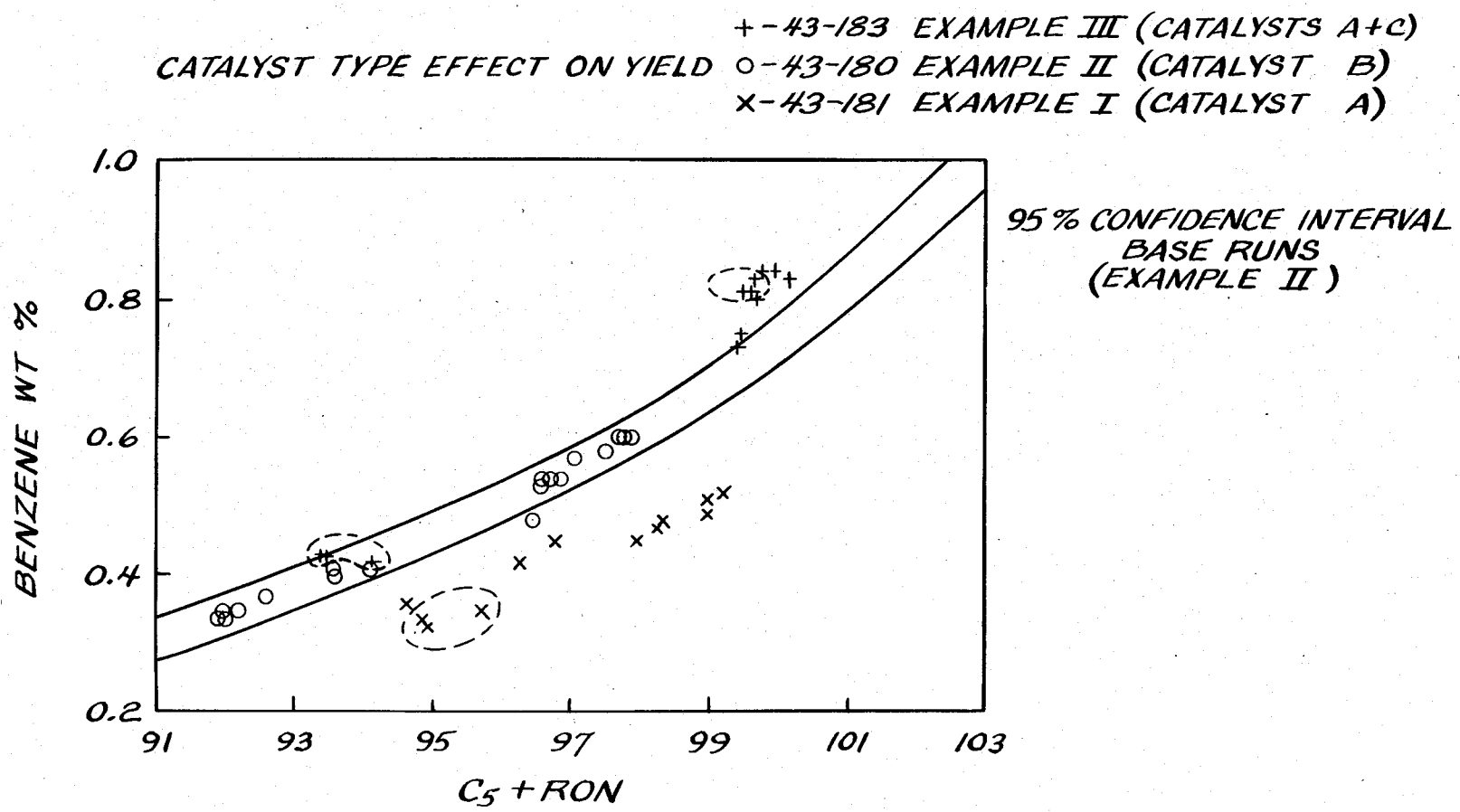
Figure 3:
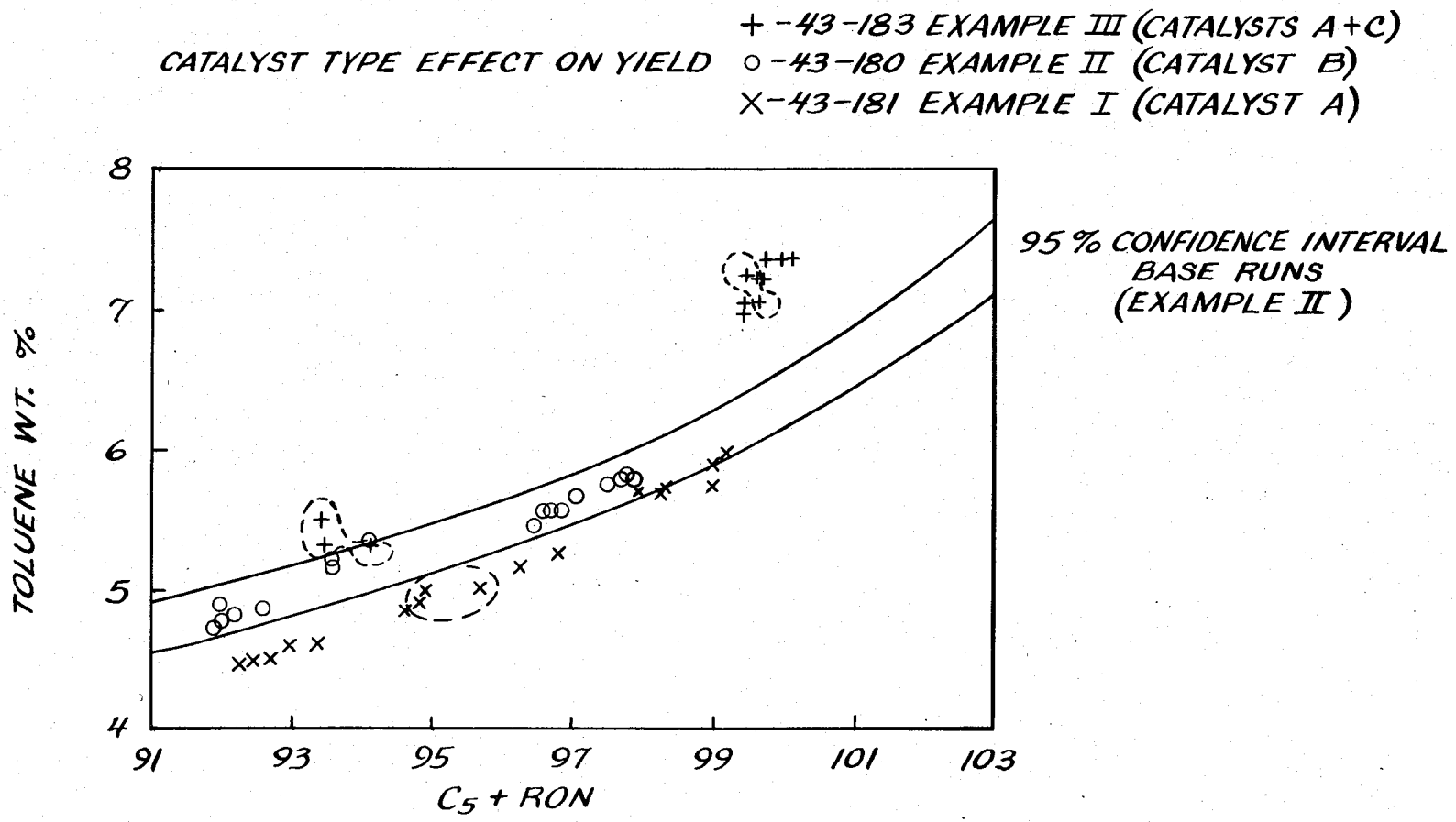
Figure 4:
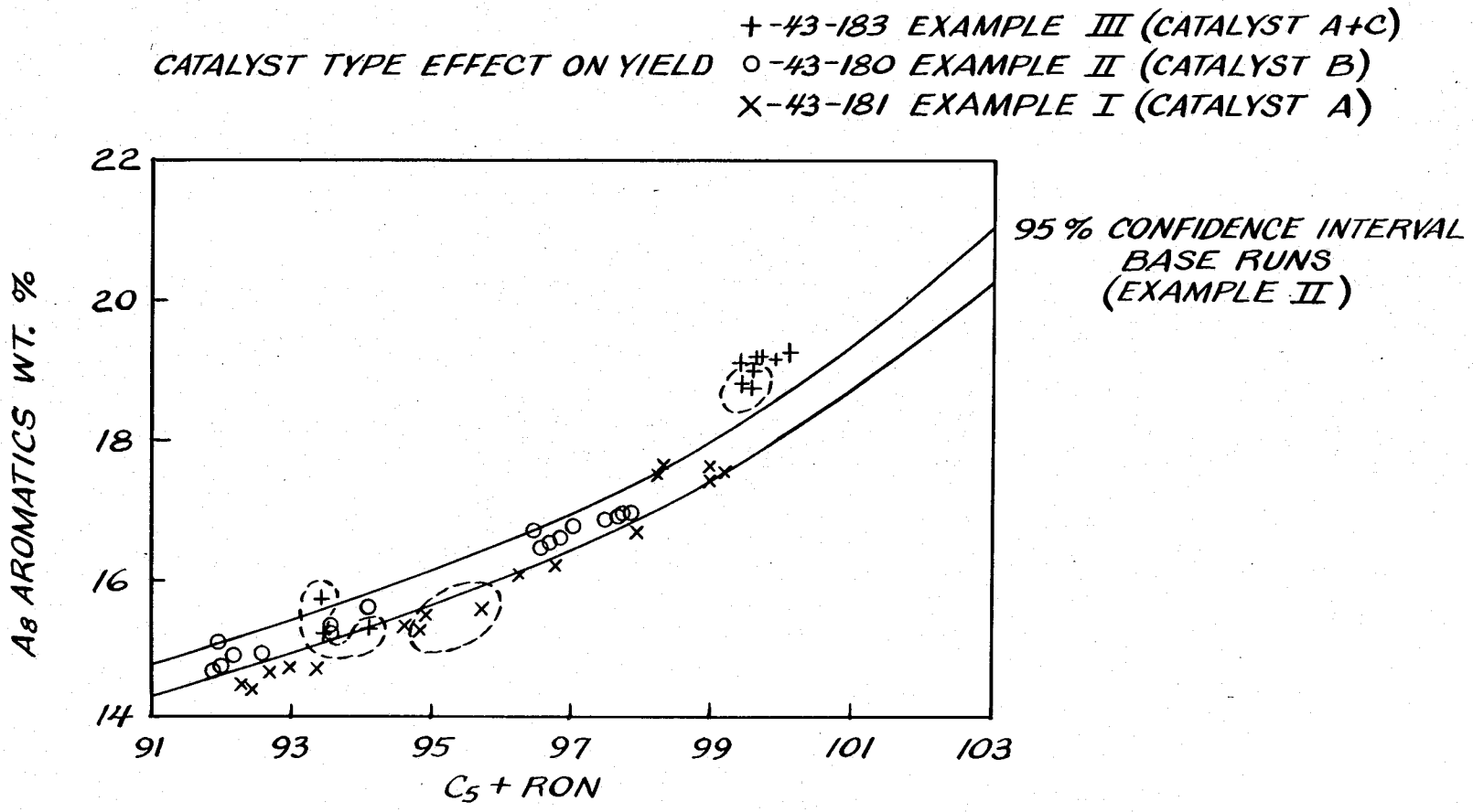
Figure 5:
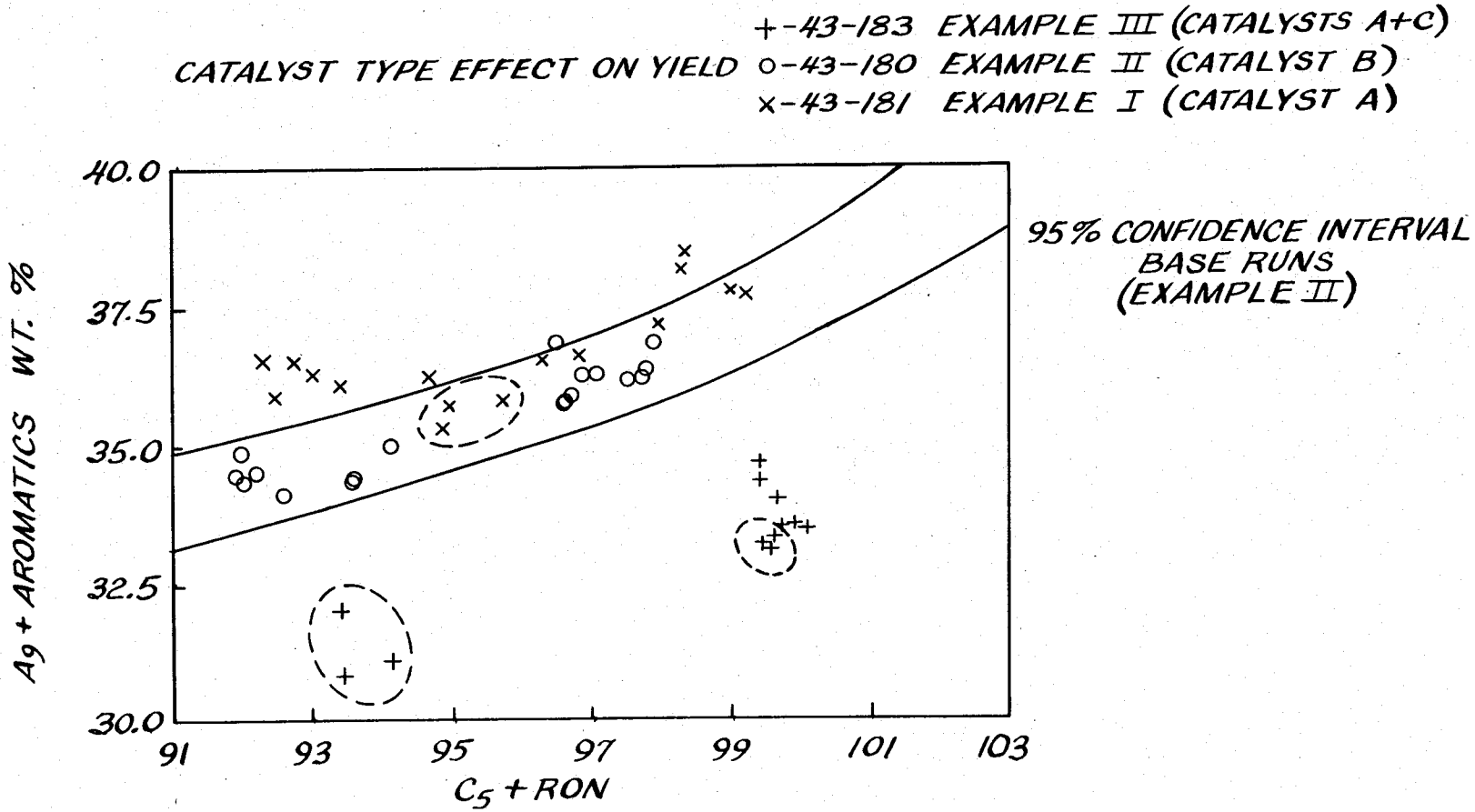

It should be noted in FIGS. 1, 2, 3, 4 and 5, Example III (which used Catalyst A followed by Catalyst C) showed improvement beyond a mere statistical variance in benzene, toluene, and $C_8$ aromatics yields when compared to either of Catalysts A or B when tested alone, and showed statistical improvement in $C_5+$ liquid when compared to Catalyst B alone.

DESCRIPTION OF THE PREFERRED EMBODIMENTS

The process of the present invention can be employed to produce high octane number blending components for unleaded motor fuels or for the production of aromatics highly useful in many chemical processes.

The process of the present invention can be employed to reform feedstocks such as virgin or cracked naphthas, or other hydrocarbon fractions boiling in the gasoline boiling range. It may also be used to reform partially-reformed naphthas and other hydrocarbon streams. A typical naphtha feedstock will exhibit a boiling range of about 70° F. to about 500° F., preferably about 180° F. to about 400° F. The partially-reformed hydrocarbon streams will exhibit an unleaded research octane number within the range of about 75 to about 95.

Since many of the above feedstocks contain appreciable amounts of nitrogen and sulfur compounds, which can be deleterious to the catalyst in a reforming process, they are often subjected to suitable hydrotreatment such as hydrotreating, prior to use in the reforming process. Such treatment reduces both the nitrogen and sulfur levels to tolerable limits.

In a preferred embodiment there is provided an improved process for reforming hydrocarbons which process comprises at least two segregated catalyst zones wherein the improvement comprises contacting a hydrocarbon stream in a first zone with a first reforming catalyst comprising tin and at least one platinum group metal deposited on a solid catalyst support followed by contacting in a second zone with a second reforming catalyst comprising at least one metal selected from the platinum group metals deposited on a solid catalyst support.

In a more preferred embodiment there is provided an improved process for reforming hydrocarbons which process comprises at least two segregated catalyst zones, wherein the improvement comprises contacting a hydrocarbon stream in a first zone with a first reforming catalyst comprising tin and at least one platinum group metal deposited on a solid catalyst support followed by contacting in a second zone with a second reforming catalyst comprising at least one metal selected from the platinum group metals deposited on a solid catalyst support and wherein the second catalyst has an essential absence of tin (preferably less than about 0.1 weight percent tin).

In an even more preferred embodiment the first reforming catalyst contains platinum and tin and the second reforming catalyst contains platinum and rhenium as the catalytic metals.

The typical fixed-bed reforming process can contain five or more serially connected reaction zones or reaction sections. Typically, each reaction section is a separate reactor when the process is operated commercially. In some cases the reactor will contain more than one bed of catalyst. The process of the present invention can be practiced as long as at least two zones exist in which the material being processed is contacted with a first catalyst comprising tin and at least one platinum group metal followed directly or indirectly by contact with a second catalyst comprising at least one metal selected from the platinum group metals. It is contemplated that the present invention can be practiced in semiregenerative type processes in which the catalyst is regenerated infrequently (up to a year or more between regenerations) or in cyclic reforming process typically referred to as the cyclic Ultraforming process as practiced by Amoco Oil Company.

In the cyclic processes one reaction zone is segregated during normal operations and put through a regeneration and reactivation procedure and thereafter phased back into the reaction train. Another reaction zone in the reaction train is then segregated from the active process, purged and put through the same cycle of regeneration and reactivation. A swing reactor is provided to replace the reactor being regenerated during the process cycle. In such cyclic processes, the catalyst is maintained in a relatively fresh state compared to the semiregenerative type processes.

In either cyclic or semiregenerative reforming processes the individual catalyst zones are typically located in separate reaction vessels, although in some processes it is possible that the reaction zones or sections could be separate catalyst beds in a single reaction vessel. The segregated catalyst zones may also have one or more reaction zones or sections located between them. These reaction zones or sections may contain catalyst having a composition different than in either of the two catalyst zones. The catalyst or reaction zones could comprise one or more reactors or catalyst beds.

In catalytic reforming of naphthas many different reactions take place within in the various reaction zones. Typically, dehydrogenation of cyclic paraffins takes place in initial reaction zones followed by dehydrocyclization in the intermediate reaction zones. Hydrocracking of paraffinic materials generally occurs in the terminal reaction zones.

In a typical cyclic reformer, such as an Ultraformer, three to five separate reactors are serially connected with an extra swing reactor provided to replace the reactor which is being regenerated. In such a configuration the first reactor would preferrably contain a catalyst particularly adapted to dehydrogenation—typically a platinum group metal on an alumina catalyst. The second and third reactors would generally contain the first reforming catalyst as described herein, while the fourth and fifth reactors would generally contain the second reforming catalyst as described herein.

In the above configuration it would be preferred to operate the first reactor using a reforming catalyst containing platinum, with the second and third reactors containing a platinum-tin reforming catalyst with the fourth and fifth reactors containing a platinum or platinum-rhenium reforming catalyst. The swing reactor can contain either a platinum, platinum-rhenium or a platinum-tin reforming catalyst.

Since the primary incentive for mixed catalyst loadings is maximizing refiner profit to accommodate changing markets and feed availability, it can be seen that no particular catalyst combination need always be used. However, the advantages which result from employing the present invention—namely, increased benzene, toluene and xylene production along with $C_5+$ yield increases, require a specific sequence of catalysts located within a reforming process. As described herein, the first reforming catalyst containing tin and at least one platinum group metal must be followed directly, or indirectly through one or more catalyst beds, reaction zones or reaction vessels, by a second reforming catalyst containing a platinum group metal.

Typical reforming operating conditions that can be used in the present invention comprise a reactor inlet temperature of about 800° F. to about 1,020° F., a pressure of about 50 psig or less to about 1,000 psig, a weight hourly space velocity (WHSV) of about 0.5 to about 10, and a hydrogen circulation rate of about 500 standard cubic feet per barrel (SCFB) to about 15,000 SCFB. Preferred operating conditions comprise an inlet temperature of about 900° F. to about 980° F., a pressure of about 50 psig to about 300 psig, a WHSV of about 1 to about 4, and a hydrogen circulation rate of about 1,000 SCFB to about 10,000 SCFB.

The claimed process can be carried out in any of the conventional types of equipment known in the art. One may, for example, employ catalysts in the form of pills, pellets, granules, broken fragments or various special shapes, disposed in one or more fixed beds within one or more reaction zones. The feed may be passed therethrough in the liquid, vapor, or mixed phase, and in side ways, upward or downward flow. Alternatively, the catalyst may be in a suitable form for use in moving beds, in which the feed and catalyst are preferably passed in countercurrent or crosscurrent flow. Fluidized-solid processes, in which the feed is passed upward through one or more turbulent beds of finely-divided catalyst may also be used as well as the suspension processes, in which the catalyst is slurried in the charging stock and the resulting mixture is conveyed into one or more reaction zones.

The reaction products from the foregoing processes are removed from the reaction zones and fractionated to recover the various components thereof. The hydrogen and unconverted materials are recycled as desired. The excess hydrogen produced in a reformer can conveniently be utilized in the hydrodesulfurization of the naphtha feed, if needed.

Unwanted products in the reforming of petroleum hydrocarbon streams are light hydrocarbon gases and coke. Such products and other compounds, such as polynuclear aromatics and heavy hydrocarbons, may result in coke. As the reforming operation progresses, a substantial amount of coke accumulates on the surface of the catalyst resulting in catalyst deactivation. Consequently, the coke must be removed periodically from the surface. Such coke removal may be accomplished through a coke-burn treatment wherein the coked catalyst is contacted with an oxygen-containing gas at selected temperatures. Typically, the regeneration gas will contain oxygen within the range of about 1 vol. % to about 21 vol. %. The concentration of oxygen in the gas should be maintained at a level which will result in the production of temperatures that will not be in excess of 1,100° F., preferably not in excess of 1,050° F.

After regeneration, the catalyst is rejuvenated using any of a number of procedures which add various components to the catalyst to improve its properties. Typically, rejuvenation is accomplished by addition of a halogen such as a chloride to the catalyst.

Two catalysts which can be used in the claimed process are a first reforming catalyst containing tin and a platinum group metal and a second catalyst containing a platinum group metal with or without rhenium. Platinum, rhenium, and tin catalysts are generally described in U.S. Pat. No. 3,702,294, Rausch, issued Nov. 7, 1972, which is incorporated by reference into this specification. The typical platinum-rhenium reforming catalysts and methods for making them are described in U.S. Pat. No. 3,415,737, Kluksdahl, which is also incorporated by reference into this specification.

Each of the catalysts required in the process of this invention employ a porous carrier material or support having combined therewith catalytically effective amounts of the required metals and, in a preferred instance, a halogen component.

The carrier materials utilized as catalysts supports are preferably materials that have porous, high surface areas of from about 25 to about 500 $m^2/g$. The porous carrier materials should be relatively inert to the conditions utilized in the reforming process and can include traditional materials such as ceramics, clays, aluminas, or silica-alumina compositions, or many other inorganic oxides well known to the art. Additionally, the support can in some instances contain materials such as crystalline aluminosilicates or crystalline borosilicates whether synthetically prepared or naturally occurring. Carbon supports can also be used.

The preferred porous carrier materials are aluminas such as crystalline gamma, eta, and theta alumina with gamma or eta alumina giving the best results. The alumina carrier may also contain minor portions of other known refractory or active materials depending upon the particular properties desired. The carrier materials should have an apparent bulk density of about 0.3 to about 0.9 g/cc. The average pore diameter of the support can vary from about 40 to about 300 Angstroms and its pore volume is about 0.1 to about 1 cc/g. The carrier can be in any of the forms described above and is preferably a spherical particle or an extrudate having anywhere from a 1/32nd to a 1/4th inch overall diameter, preferably 1/16 to 1/12 inch diameter.

One essential constituent of the first catalyst of the present invention is a tin component which is utilized in an amount sufficient to result in a final catalytic composite containing about 0.01 to about 5 weight percent tin and preferably about 0.05 to about 2 weight percent tin calculated on an elemental basis.

The tin component may be incorporated in the catalytic composite in any suitable manner known to the art to result in a relatively uniform dispersion of the tin moiety on the carrier material, such as by coprecipitation or cogellation with the porous carrier material, ion exchange with the gelled carrier material, or impregnation with the carrier material either after, before, or during the period when it is dried and calcined. It is to be noted that it is intended to include within the scope of the present invention all conventional methods for incorporating and simultaneously uniformly distributing a metallic component in a catalytic composite and the particular method of incorporation used is not deemed to be an essential feature of the present invention.

One method of incorporating the tin component into the catalytic composite involves cogelling or coprecipitating the tin component during the preparation of the preferred carrier material, alumina. This method typically involves the addition of a suitable sol-soluble tin compound such as stannous chloride, stannic chloride and the like to the alumina hydrosol and then combining the hydrosol with a suitable gelling agent and dropping the resulting mixture into an oil bath. Alternatively, the tin compound can be added to the gelling agent. After drying and calcining the resulting gelled carrier material in air, there is obtained an intimate combination of alumina and tin oxide.

A preferred method of incorporating the tin component into the catalytic composite involves utilization of a soluble, decomposable compound of tin to impregnate the porous carrier material. In general, the solvent used in this impregnation step is selected on the basis of the capability to dissolve the desired tin compound without adversely affecting the carrier material or the other ingredients of the catalyst—for example, a suitable alcohol, ether, acid and the like solvents. The solvent is preferably an aqueous, acidic solution. Thus, the tin component may be added to the carrier material by commingling the latter with an aqueous acidic solution of suitable tin salt, complex, or compound such as stannous bromide, stannous chloride, stannic chloride, stannic chloride pentahydrate, stannic chloride diamine, stannic trichloride bromide, stannic chlorate, stannous fluoride, stannic iodide, stannous sulfate, stannic tartrate and the like compounds. A particularly preferred impregnation solution comprises an acidic aqueous solution of stannic or stannous chloride. Suitable acids for use in the impregnation solution are inorganic acids such as hydrochloric acid, nitric acid, and the like, and strongly acidic organic acids such as oxalic acid, malonic acid, citric acid, and the like. In general, the tin component can be impregnated either prior to, simultaneously with, or after the other ingredients are added to the carrier material. However, excellent results are obtained when the tin component is incorporated in the carrier material during its preparation and the platinum group metal and other components, such as rhenium when used, can be added in a subsequent impregnation after the tin-containing carrier material is calcined. When the tin component is added simultaneously with the other components, a preferred impregnation solution is an aqueous solution of chloroplatinic acid, hydrochloric acid and stannous or stannic chloride.

An essential ingredient for use in both the first and second catalysts of the subject process is at least one platinum group metal component. The platinum group metals include platinum, iridium, ruthenium, rhodium, palladium and osmium, or mixtures thereof. Generally, the amount of the platinum group metal present in the final catalytic composite is small compared to the quantities of the other components combined therewith. In fact, the platinum group component generally will comprise about 0.01 to about 2 weight percent of the final catalytic composite, calculated on an elemental basis. Excellent results are obtained when the catalyst contains about 0.05 to about 1 weight percent of the platinum group metal. Particularly preferred mixtures of these metals are platinum and palladium. Platinum as the sole platinum group metal on the catalytic composites is especially preferred.

The platinum group metal may be incorporated in the catalytic composite in any suitable manner known to result in a relatively uniform distribution of this component in the carrier material such as coprecipitation or cogellation, ion exchange or impregnation. The preferred method of preparing the catalyst involves the utilization of a soluble, decomposable compound of platinum group metal to impregnate the carrier material in a relatively uniform manner. For example, this component may be added to the support by commingling the latter with an aqueous solution of chloroplatinic or chloroiridic or chloropalladic acid. Other water-soluble compounds or complexes of platinum group metals may be employed in impregnation solutions and include ammonium chloroplatinate, bromoplatinic acid, platinum trichloride, platinum tetrachloride hydrate, platinum dichlorocarbonyl dichloride, sodium tetranitroplatinate, palladium chloride, palladium nitrate, palladium sulfate, rhodium carbonylchloride, rhodium trichloride hydrate, rhodium nitrate, sodium hexachlororhodate, sodium hexanitrorhodate, iridium tribromide, iridium dichloride, iridium tetrachloride, sodium hexanitroiridate, potassium or sodium chloroiridate, potassium rhodium oxalate, etc. The utilization of a platinum, iridium, rhodium, or palladium chloride compound, such as chloroplatinic, chloroiridic, or chloropalladic acid or rhodium trichloride hydrate, is preferred since it facilitates the incorporation of both the platinum group components and at least a minor quantity of a halogen component in a single step.

Rhenium is an optional component of the second catalyst used in the present invention. It may also be placed on the first catalyst but little advantage seems to result from the combination of rhenium with platinum and tin. The rhenium component of the catalyst is generally present in the elemental metal. The rhenium component is preferably utilized in an amount sufficient to result in a final catalytic composite containing about 0.01 to about 2 weight percent rhenium and preferably about 0.05 to about 1 weight percent, calculated on an elemental basis.

The rhenium component may be incorporated in the catalytic composite in any suitable manner and at any stage in the preparation of the catalyst. It is generally advisable to incorporate the rhenium component in an impregnation step after the porous carrier material has been formed in order that the expensive metal will not be lost due to washing and purification treatments which may be applied to the carrier material during the course of its production. Although any suitable method for incorporating a catalytic component in a porous carrier material can be utilized to incorporate the rhenium component, the preferred procedure involves impregnation of the porous carrier material. The impregnation solution can, in general, be a solution of a suitable soluble, decomposable rhenium salt such as ammonium perrhenate, sodium perrhenate, potassium perrhenate, and the like salts. In addition, solutions of rhenium halides such as rhenium chlorides may be used. The preferred impregnation solution is an aqueous solution of perrhenic acid. The porous carrier material can be impregnated with the rhenium component either prior to, simultaneously with, or after the other components mentioned herein are combined therewith. Best results are ordinarily achieved when the rhenium component is impregnated simultaneously with the platinum group component. In fact, excellent results have been obtained with a one-step impregnation procedure utilizing as an impregnation solution, an aqueous solution of chloroplatinic acid, perrhenic acid, stannic chloride, and hydrochloric acid.

It is generally preferred to incorporate a halogen component into both the first and second catalysts of the present invention.

Although the precise form of the chemistry of the association of the halogen component with the carrier material is not entirely known, it is customary in the art to refer to the halogen component as being combined with the carrier material, or with the other ingredients of the catalyst. This combined halogen may be either fluorine, chlorine, iodine, bromine, or mixtures thereof. Of these, fluorine and chlorine are preferred with chlorine especially preferred. The halogen may be added to the carrier material in any suitable manner, either during preparation of the support or before or after the addition of the other components. For example, the halogen may be added, at any stage of the preparation of the carrier material or to the calcined carrier material, as an aqueous solution of a suitable, decomposable halogencontaining compound such as hydrogen fluoride, hydrogen chloride, hydrogen bromide, ammonium chloride, etc. The halogen component or a portion thereof, may be combined with the carrier material during the impregnation of the latter with the platinum group component through the utilization of a mixture of chloroplatinic acid and hydrogen chloride. In another situation, the alumina hydrosol which is typically utilized to form the preferred alumina carrier material may contain halogen and thus contribute at least a portion of the halogen component to the final composite. For reforming, the halogen will typically be combined with the carrier material in an amount sufficient to result in a final composite that contains about 0.1 to about 3.5 percent, and preferably about 0.5 to about 1.5 percent, by weight of halogen calculated on an elemental basis.

Additional amounts of the halogen component may also be added to the catalyst after regeneration during the rejuvenation step.

The amount of the rhenium component is ordinarily selected so that the atomic ratio of rhenium to platinum group metal contained in the composite is about 0.1:1 to about 3:1, with the preferred range being about 0.25:1 to about 1.5:1. Similarly, the amount of the tin component is ordinarily selected to produce a composite containing an atomic ratio of tin to platinum group metal of about 0.1:1 to about 3:1, with the preferred range being about 0.25:1 to about 2:1.

Another significant parameter for the instant catalyst is the total metals content (defined as the art recognized catalytic metals including for example the platinum group component, tin and rhenium component) calculated on an elemental metal basis. Good results are ordinarily obtained with the subject catalyst when the above defined parameter is fixed at a value of about 0.15 to about 5 weight percent, with best results ordinarily achieved at a total metals loading of about 0.3 to about 2 weight percent.

Integrating the above discussion of each of the essential and preferred components of the catalytic composites used in the claimed process, it is evident that a particularly preferred first catalyst comprises a combination of a platinum group component, a tin component, and a halogen component with an alumina carrier material in amounts sufficient to result in the composite containing about 0.5 to about 1.5 weight percent halogen, about 0.05 to about 1 weight percent platinum group component, and about 0.05 to about 2 weight percent tin. Accordingly, specific examples of an especially preferred first catalyst comprise: (1) a combination of from about 0.1 to about 1.0 weight percent tin, from about 0.1 to about 1.0 weight percent platinum, and from about 0.5 to about 1.5 weight percent halogen on an alumina carrier material; (2) a catalyst composite comprising a combination of from about 0.1 to about 0.75 weight percent tin, from about 0.1 to about 0.75 weight percent platinum, and from about 0.5 to about 1.5 weight percent halogen on an alumina carrier material; (3) a catalytic composite comprising a combination of about 0.4 weight percent tin, about 0.4 weight percent platinum, and about 0.5 to about 1.5 weight percent halogen on an alumina carrier material; (4) a catalytic composite comprising a combination of about 0.4 weight percent tin, from about 0.1 to about 0.75 weight percent platinum, and from about 0.5 to about 1.5 weight percent halogen on an alumina carrier material; (5) a catalytic composite comprising a combination of from about 0.1 to about 0.75 weight percent tin, about 0.4 weight percent platinum, and from about 0.5 to about 1.5 weight percent halogen on an alumina carrier material; and (6) a catalytic composite comprising a combination of from about 0.2 to about 0.6 weight percent tin, from about 0.2 to about 0.6 weight percent platinum, and from about 0.5 to about 1.5 weight percent halogen on an alumina carrier material. The amounts of the components reported above are calculated on an elemental basis.

Optionally, the first catalyst can contain rhenium as a third metallic component in an amount ranging from about 0.05 weight percent to about 2 weight percent and preferably from about 0.1 weight percent to about 1.0 weight percent of the catalyst.

A particularly preferred second catalyst comprises a platinum and a halogen component on an alumina carrier in amounts sufficient to result in the composite containing about 0.5 to about 1.5 weight percent halogen and about 0.05 to about 1 weight percent based on the catalyst composite of a platinum group metal which is preferably platinum. Optionally, the second catalyst can contain rhenium as a second metallic component in an amount ranging from about 0.05 weight percent to about 2 weight percent and preferably from about 0.05 weight percent to about 1 weight percent of the catalyst.

Accordingly, specific examples of an especially preferred second catalyst comprise: (1) a combination of from about 0.1 to about 0.75 weight percent platinum, and about 0.5 to about 1.5 weight percent halogen with an alumina carrier material; (2) a catalyst composite comprising a combination of from about 0.1 to about 0.75 weight percent platinum, from about 0.1 to about 0.75 weight percent rhenium and about 0.5 to about 1.5 weight percent halogen on an alumina carrier material; (3) a catalytic composite comprising a combination of about 0.4 weight percent platinum, about 0.4 weight percent rhenium and about 0.5 to about 1.5 weight percent halogen on an alumina carrier material; (4) a catalytic composite comprising a combination of about 0.4 weight percent platinum, about 0.1 to about 1.0 weight percent rhenium and about 0.5 to about 1.5 weight percent halogen on an alumina carrier material; and (5) a catalytic composite comprising a combination of from about 0.1 to about 1.0 weight percent platinum, about 0.4 weight percent rhenium and about 0.5 to about 1.5 weight percent halogen on an alumina carrier material. The amounts of the components reported above are calculated on an elemental basis.

In the Examples, three tests were run to illustrate the present process invention. The three catalysts used were Catalyst A, Catalyst B and Catalyst C.

Catalyst A is a commercially available platinum-tin reforming catalyst which comprises platinum and tin on an alumina base. This material had approximately 0.38 weight percent platinum and contained about 0.9 weight percent chloride, had a bulk density of about 33.7 lb./cu. ft. and a surface area of about 200 square meters per gram. It was produced as 1/16 inch spheres. The tin content of this catalyst was thought to be about 0.38 weight percent.

Catalyst B which is a commercially available platinum-rhenium reforming catalyst containing 0.37 weight percent platinum, 0.37 weight percent rhenium, and 0.92 weight percent chloride. The bulk density of this material was approximately 40 lb./cu. ft., it had a surface area of about 184 square meters per gram, and was produced as a 1/12 inch diameter extrudate.

Catalyst C is a commercially available platinum containing reforming catalyst containing 0.78 weight percent platinum and 0.9 weight percent chloride. This catalyst has no tin added to it during manufacturing and was essentially free of tin. This catalyst had a bulk density of approximately 40 lb./cu. ft. a surface area of about 184 square meters per gram and was produced as a 1/12 inch diameter extrudate.

These catalysts were tested in a small multi-stage catalyst testing pilot plant which had a one-inch schedule 80 pipe reactor made up of nine separate zones. Zones 5 and 7 in the reactor were nine inches long and the remaining zones were each six inches in length. Zones 3, 5, and 7 contained catalyst which was mixed with an inert carrier, either alumina or glass beads, in order to occupy the entire volume of the respective zones. Zones 1 and 9 were the inlet and outlet, respectively, for the reactor and were filled with an inert material to aid in distribution of feed and effluent. The remaining zones between the catalyst beds were filled with an inert carrier to occupy available volume within each zone.

The reactor tube contained appropriate insulation and heating control so that the overall temperature for the inlets to the three catalyst zones were balanced. The reactor operated in an adiabatic mode. The Kinetic average temperature reported in the Tables for the Examples is the same as the equivalent isothermal temperature determined according to the following article: J. B. Malloy and H. S. Seelig, "Equivalent Isothermal Temperatures for Nonisothermal Reactors," *A.I.Ch.E. Journal*, December 1955, p. 528.

The pilot plant testing equipment contained appropriate recycle and pressure control equipment in addition to standard separation and sampling equipment so that yields of the various materials produced in the reactor could be determined.

The feedstock used for all three tests is designated as Feed 284 in the reported data and was a heavy naphtha cut from an Arabian light crude. The properties of this feed used are listed in the Table below.

FEED PROPERTIES

| COMPONENT | VOLUME PERCENT |
|---|---|
| PARAFFINS | 67.9 |
| $C_5$ | 0.0 |
| $C_6$ | 0.10 |
| $C_7$ | 3.98 |
| $C_8$ | 18.36 |
| $C_9$ | 16.91 |
| $C_{10}$ | 15.37 |
| $C_{11}$ | 9.94 |
| $C_{12}+$ | 3.26 |
| NAPHTHENES | 18.6 |
| $C_5$ | 0.0 |
| $C_6$ | 0.06 |
| $C_7$ | 1.59 |
| $C_8$ | 4.68 |
| $C_9$ | 5.05 |
| $C_{10}$ | 3.87 |
| $C_{11}$ | 2.50 |
| $C_{12}+$ | 0.82 |
| AROMATICS | 13.5 |
| $C_6$ | 0.0 |
| $C_7$ | 1.19 |
| $C_8$ | 3.78 |
| $C_9$ | 4.46 |
| $C_{10}$ | 4.04 |
| $C_{11}$ | 0.05 |
| $C_{12}+$ | 0.0 |
| RESEARCH OCTANE NUMBER | 25.8 |
| API GRAVITY | 55.2° |
| ASTM INITIAL BOILING POINT | 245° F. |
| 10% | 271° F. |
| 30% | 285° F. |
| 50% | 301° F. |
| 70% | 324° F. |
| 90% | 352° F. |
| END BOILING POINT | 389° F. |

EXAMPLE I

In this Example, Catalyst A which was a commercial platinum-tin containing reforming catalyst was located in all three of the catalyst zones of the reactor. In zone 3, 23 grams of Catalyst A were diluted with sufficient alumina balls to occupy 77 $cm^3$ bulk volume total, in zone 5, 46 grams of Catalyst A were diluted with sufficient alumina balls to occupy 116 $cm^3$ total bulk volume, and in zone 7, 46 grams of Catalyst A were combined with sufficient alumina balls to occupy 116 $cm^3$ total bulk volume. The catalyst was started up on the feed described above and operated for a period of approximately 122 hours over 24 separate test periods. The operating conditions throughout the test including selected data generated from the various test periods is shown in Table I. It should be noted that Test Periods 19, 20 and 24 while reported in the Table and plotted on the attached Figures, do not reflect true capabilities of Catalyst A since it was determined beginning with Test Period 19 that the coke laid down on the catalyst reduced its activity to the extent that the data generated during these three Test Periods did not reflect a valid indication of performance of Catalyst A. Also, Test Periods 15, 16, 17, 18, 20, 22 and 23 were lost due to mechanical malfunctions which may have affected the integrity of the data of Test Periods 19, 20 and 24 but which had no effect on Test Periods 1 to 14.

EXAMPLE II

In this Example, Catalyst B which was a commercial platinum-rhenium reforming catalyst described above was placed in the reactor also described above. Catalyst B was diluted with alumina balls in each of the three catalyst zones with 30 grams of Catalyst B combined with sufficient alumina balls to occupy 77 $cm^3$ total bulk volume in zone 3, 60 grams of Catalyst B combined with sufficient alumina balls to occupy 116 $cm^3$ total bulk volume in zone 5, and 60 grams of Catalyst B combined with sufficient alumina balls to occupy 116 $cm^3$ total bulk volume in zone 7. These catalyst weights were selected to give exactly the same volume of catalyst as occupied by the weights of Catalyst A used in Example I.

The unit was placed in a start-up mode, and the feedstock described above was used. Testing lasted approximately 92 hours with 19 separate Test Periods. The data generated and the various operating conditions used for this test are reported in Table II. It should be noted that all the data reported in Table II were used in the Figures attached as Catalyst B did not have any Test Periods under upset conditions. The catalyst did not coke up to adversely affect its overall performance due to the rhenium present in the catalyst and due to the shorter time on oil versus Example I.

EXAMPLE III

In this Example, a mixed loading of Catalyst A (platinum-tin) and Catalyst C (platinum) was used to illustrate the process of the invention. In the tests performed on the combined use of Catalyst A followed by Catalyst C, 23 grams of Catalyst A were blended with sufficient alumina balls to occupy 77 $cm^3$ total bulk volume and placed in zone 3 in the reactor. In zone 5, 46 grams of Catalyst A were blended with sufficient alumina balls to occupy 116 $cm^3$ total bulk volume, while in zone 7, 60 grams of Catalyst C were blended with sufficient alumina balls to occupy 116 $cm^3$ total bulk volume. These catalyst weights were selected to give exactly the same volume of catalyst as occupied by the weights of catalysts A and B used in Examples I and II.

The test for the split loading of catalyst was conducted by initially starting up the Catalysts using a Mid-Continent naphtha feed (identified as Feed 274 in the reported data in Table III) followed by test periods using the heavy cut of Arabian light naphtha (Feed 284 in the Table described above). At the end of the test the feed was switched back to the Mid-Continent feed. The test data reported in this Example are only for Test Periods 9 through 20 during which the heavy cut of Arabian light naphtha was used as feedstock. Test Periods 15, 16, 17, 18, 19, and 20 for this run are reported in the Figures as low activity periods. The data taken during these periods was at a time when excess coke lay down on Catalysts A and C adversely affected their performance. The data therefore reported for Test Periods 15, 16, 17, 18, 19, and 20 do not adequately reflect the performance of combined Catalyst A and Catalyst C.

The test data generated for this Example is reported in Table III.

TABLE I

AU43-181, PROCESSING CONDITIONS AND YIELDS

| PERIOD NUMBER | 1 | 2 | 3 | 4 | 5 | 6 | 7 | 8 | 9 |
|---|---|---|---|---|---|---|---|---|---|
| PERIOD LENGTH, HOURS | 2.9 | 2.9 | 2.9 | 2.9 | 2.9 | 2.9 | 2.9 | 2.9 | 2.9 |
| TIME ON OIL, HOURS | 13.0 | 17.9 | 22.0 | 26.0 | 30.0 | 34.0 | 38.0 | 42.0 | 49.0 |
| FEED IDENTIFICATION, | 284 | 284 | 284 | 284 | 284 | 284 | 284 | 284 | 284 |
| OPERATING CONDITIONS | | | | | | | | | |
| PRESSURE, PSIG | 300.6 | 300.6 | 300.6 | 300.6 | 300.7 | 300.6 | 300.6 | 300.6 | 300.6 |
| RECYCLE GAS RATE, SCFB | 2947. | 2931. | 2792. | 2925. | 2924. | 2929. | 2926. | 2878. | 3003. |
| H2 PARTIAL PRESSURE, PSIA | 212.4 | 212.1 | 212.3 | 215.0 | 215.5 | 216.3 | 215.7 | 215.7 | 208.7 |
| HC PARTIAL PRESSURE, PSIA | 67.2 | 67.5 | 70.1 | 67.6 | 67.6 | 67.5 | 67.6 | 68.5 | 66.2 |
| H/HC RATIO | 3.16 | 3.14 | 3.03 | 3.18 | 3.19 | 3.20 | 3.19 | 3.15 | 3.15 |
| SPACE VELOCITY, WHSV | 4.041 | 4.060 | 4.895 | 5.265 | 5.238 | 5.271 | 5.284 | 5.292 | 5.210 |
| WT PERCENT RECOVERY | 99.93 | 99.77 | 100.35 | 100.20 | 100.48 | 100.05 | 99.96 | 99.69 | 99.29 |
| PRODUCT QUALITY | | | | | | | | | |
| C5+ RESEARCH OCTANE | 96.78 | 96.25 | 94.63 | 93.35 | 92.97 | 92.69 | 92.44 | 92.27 | 99.16 |
| C5+ GRAVITY, API | 43.56 | 43.70 | 44.36 | 44.57 | 44.99 | 45.05 | 45.46 | 45.50 | 41.77 |
| ACTIVITY DATA | | | | | | | | | |
| KINETIC AVG. TEMP., F. | 924.6 | 925.0 | 925.4 | 925.2 | 925.5 | 925.3 | 925.6 | 925.9 | 959.8 |
| YIELDS, VOL PERCENT ON FEED | | | | | | | | | |
| C5+ ULTRAFORMATE | 79.95 | 79.94 | 81.12 | 82.26 | 82.75 | 82.85 | 82.99 | 83.37 | 77.10 |
| C6+ ULTRAFORMATE | 72.58 | 73.30 | 75.06 | 76.63 | 77.41 | 77.85 | 77.56 | 78.38 | 70.30 |
| YIELDS, WT PERCENT ON FEED | | | | | | | | | |
| HYDROGEN | 1.94 | 1.94 | 1.87 | 1.84 | 1.82 | 1.82 | 1.80 | 1.81 | 2.14 |
| METHANE | 1.42 | 1.37 | 1.29 | 1.18 | 1.17 | 1.16 | 1.21 | 1.16 | 1.74 |
| ETHANE | 2.46 | 2.40 | 2.20 | 2.02 | 2.01 | 1.99 | 2.01 | 1.95 | 3.04 |
| PROPANE | 4.17 | 4.02 | 3.71 | 3.40 | 3.33 | 3.30 | 3.30 | 3.18 | 4.54 |
| ISO-BUTANE | 2.07 | 1.99 | 1.82 | 1.67 | 1.60 | 1.58 | 1.57 | 1.51 | 2.12 |
| NORMAL BUTANE | 2.67 | 3.08 | 2.98 | 2.67 | 2.53 | 2.52 | 2.56 | 2.44 | 3.34 |
| ISO-PENTANE | 4.01 | 3.52 | 3.20 | 2.98 | 2.82 | 2.63 | 2.86 | 2.62 | 3.44 |
| NORMAL PENTANE | 2.09 | 1.98 | 1.81 | 1.68 | 1.60 | 1.51 | 1.63 | 1.51 | 2.19 |
| C5+ ULTRAFORMATE | 85.27 | 85.19 | 86.12 | 87.22 | 87.54 | 87.61 | 87.55 | 87.94 | 83.07 |
| SATURATES (I-PARAFFINS INCLUDE UNIDENTIFIED NAPHTHENES) | | | | | | | | | |
| CP | 0.33 | 0.32 | 0.29 | 0.26 | 0.25 | 0.23 | 0.25 | 0.22 | 0.29 |
| IP6 | 3.16 | 3.22 | 3.03 | 2.77 | 2.70 | 2.58 | 2.74 | 2.55 | 3.07 |
| NP6 | 1.21 | 1.22 | 1.15 | 1.05 | 1.04 | 1.00 | 1.05 | 0.99 | 1.23 |
| IP7 | 4.13 | 4.16 | 4.15 | 4.17 | 4.16 | 4.08 | 4.16 | 4.08 | 3.46 |
| NP7 | 1.22 | 1.24 | 1.29 | 1.36 | 1.37 | 1.37 | 1.40 | 1.39 | 1.05 |
| IP8 | 5.94 | 6.17 | 7.21 | 8.04 | 8.17 | 8.26 | 8.30 | 8.37 | 3.93 |
| NP8 | 1.35 | 1.41 | 1.77 | 2.07 | 2.11 | 2.16 | 2.18 | 2.22 | 0.94 |
| P9+ | 3.23 | 3.69 | 5.38 | 7.09 | 7.38 | 7.78 | 7.87 | 8.18 | 1.62 |
| AROMATICS | | | | | | | | | |
| BENZENE | 0.45 | 0.42 | 0.36 | 0.30 | 0.28 | 0.27 | 0.27 | 0.24 | 0.52 |
| TOLUENE | 5.28 | 5.17 | 4.86 | 4.63 | 4.61 | 4.52 | 4.50 | 4.47 | 5.99 |
| TOTAL A8 | 16.24 | 16.10 | 15.35 | 14.74 | 14.76 | 14.70 | 14.45 | 14.52 | 17.59 |
| P + M XYLENE | 9.02 | 8.82 | 8.35 | 7.95 | 7.98 | 7.94 | 7.79 | 7.84 | 9.85 |
| O XYLENE | 3.99 | 4.03 | 3.84 | 3.66 | 3.65 | 3.62 | 3.56 | 3.57 | 4.24 |
| A9+ | 36.66 | 36.59 | 36.27 | 36.11 | 36.32 | 36.56 | 35.93 | 36.58 | 37.76 |
| TOTAL | 58.63 | 58.28 | 56.84 | 55.78 | 55.96 | 56.05 | 55.15 | 55.81 | 61.86 |

| PERIOD NUMBER | 10 | 11 | 12 | 13 | 14 | 19 | 21 | 24 |
|---|---|---|---|---|---|---|---|---|
| PERIOD LENGTH, HOURS | 2.9 | 2.0 | 2.0 | 1.0 | 2.9 | 2.9 | 2.9 | 1.3 |
| TIME ON OIL, HOURS | 53.0 | 56.5 | 60.5 | 64.0 | 70.0 | 95.0 | 105.0 | 122.1 |
| FEED IDENTIFICATION, | 284 | 284 | 284 | 284 | 284 | 284 | 284 | 284 |
| OPERATING CONDITIONS | | | | | | | | |
| PRESSURE, PSIG | 300.6 | 300.5 | 300.6 | 300.5 | 300.5 | 300.6 | 300.6 | 303.1 |
| RECYCLE GAS RATE, SCFB | 2984. | 2983. | 2978. | 3001. | 2981. | 3067. | 3137. | 2969. |
| H2 PARTIAL PRESSURE, PSIA | 207.9 | 207.6 | 208.4 | 207.4 | 206.8 | 212.4 | 213.4 | 177.8 |
| HC PARTIAL PRESSURE, PSIA | 66.6 | 66.6 | 66.7 | 66.2 | 66.6 | 65.1 | 64.0 | 67.3 |
| H/HC RATIO | 3.12 | 3.12 | 3.13 | 3.13 | 3.11 | 3.26 | 3.34 | 2.64 |
| SPACE VELOCITY, WHSV | 5.220 | 5.224 | 5.266 | 5.226 | 5.294 | 5.153 | 5.082 | 5.198 |
| WT PERCENT RECOVERY | 99.46 | 100.14 | 99.74 | 98.91 | 98.08 | 98.64 | 99.16 | 99.25 |
| PRODUCT QUALITY | | | | | | | | |
| C5+ RESEARCH OCTANE | 98.96 | 98.96 | 98.29 | 98.22 | 97.93 | 95.69 | 94.82 | 94.91 |
| C5+ GRAVITY, API | 41.95 | 41.65 | 42.62 | 42.60 | 42.55 | 44.04 | 44.48 | 44.83 |
| ACTIVITY DATA | | | | | | | | |
| KINETIC AVG. TEMP., F. | 960.2 | 961.1 | 961.7 | 961.8 | 960.1 | 959.5 | 957.0 | 958.1 |
| YIELDS, VOL PERCENT ON FEED | | | | | | | | |
| C5+ ULTRAFORMATE | 77.71 | 77.71 | 78.34 | 78.23 | 78.35 | 79.07 | 79.47 | 80.10 |
| C6+ ULTRAFORMATE | 70.88 | 71.09 | 72.59 | 72.39 | 71.69 | 72.84 | 73.68 | 74.18 |

TABLE I-continued

| AU43-181, PROCESSING CONDITIONS AND YIELDS | | | | | | | | |
|---|---|---|---|---|---|---|---|---|
| YIELDS, WT PERCENT ON FEED | | | | | | | | |
| HYDROGEN | 2.11 | 2.09 | 2.08 | 2.08 | 2.02 | 1.73 | 1.70 | 1.80 |
| METHANE | 1.67 | 1.66 | 1.66 | 1.67 | 1.70 | 1.66 | 1.63 | 1.57 |
| ETHANE | 3.00 | 2.97 | 3.01 | 3.02 | 2.92 | 3.11 | 3.05 | 2.79 |
| PROPANE | 4.38 | 4.33 | 4.41 | 4.43 | 4.23 | 4.31 | 4.23 | 4.10 |
| ISO-BUTANE | 1.97 | 1.98 | 2.01 | 2.02 | 1.91 | 1.82 | 1.80 | 1.83 |
| NORMAL BUTANE | 3.21 | 3.17 | 2.84 | 2.89 | 3.18 | 3.29 | 3.29 | 3.09 |
| ISO-PENTANE | 3.47 | 3.34 | 2.85 | 2.89 | 3.32 | 3.11 | 2.83 | 2.94 |
| NORMAL PENTANE | 2.19 | 2.14 | 1.91 | 1.95 | 2.19 | 2.05 | 1.96 | 1.96 |
| C5+ ULTRAFORMATE | 83.65 | 83.80 | 84.00 | 83.90 | 84.04 | 84.09 | 84.31 | 84.81 |
| SATURATES (I-PARAFFINS INCLUDE UNIDENTIFIED NAPHTHENES) | | | | | | | | |
| CP | 0.29 | 0.28 | 0.25 | 0.25 | 0.25 | 0.22 | 0.22 | 0.20 |
| IP6 | 3.07 | 3.03 | 2.93 | 2.97 | 3.10 | 3.07 | 3.06 | 2.93 |
| NP6 | 1.23 | 1.21 | 1.20 | 1.21 | 1.28 | 1.27 | 1.25 | 1.23 |
| IP7 | 3.54 | 3.57 | 3.59 | 3.63 | 3.76 | 3.98 | 3.98 | 3.97 |
| NP7 | 1.07 | 1.08 | 1.10 | 1.12 | 1.18 | 1.31 | 1.33 | 1.33 |
| IP8 | 4.16 | 4.31 | 4.48 | 4.54 | 4.89 | 6.02 | 6.52 | 6.51 |
| NP8 | 1.02 | 1.07 | 1.12 | 1.14 | 1.24 | 1.59 | 1.80 | 1.78 |
| P9+ | 1.88 | 2.04 | 2.20 | 2.30 | 2.70 | 4.64 | 5.40 | 5.34 |
| AROMATICS | | | | | | | | |
| BENZENE | 0.51 | 0.49 | 0.48 | 0.47 | 0.45 | 0.35 | 0.34 | 0.33 |
| TOLUENE | 5.75 | 5.91 | 5.75 | 5.70 | 5.72 | 5.03 | 4.93 | 5.00 |
| TOTAL A8 | 17.66 | 17.48 | 17.68 | 17.53 | 16.73 | 15.61 | 15.31 | 15.53 |
| P + M XYLENE | 9.76 | 9.67 | 9.79 | 9.69 | 9.37 | 8.65 | 8.43 | 8.57 |
| O XYLENE | 4.33 | 4.27 | 4.30 | 4.25 | 3.96 | 3.70 | 3.67 | 3.70 |
| A9+ | 37.84 | 37.82 | 38.49 | 38.19 | 37.21 | 35.84 | 35.36 | 35.76 |
| TOTAL | 61.76 | 61.71 | 62.40 | 61.89 | 60.12 | 56.83 | 55.94 | 56.62 |

TABLE II

| AU43-180, PROCESSING CONDITIONS AND YIELDS | | | | | | | | | |
|---|---|---|---|---|---|---|---|---|---|
| PERIOD NUMBER | 1 | 2 | 3 | 4 | 5 | 6 | 7 | 8 | 9 |
| PERIOD LENGTH, HOURS | 2.9 | 2.9 | 2.9 | 2.9 | 2.9 | 2.9 | 2.9 | 1.3 | 2.9 |
| TIME ON OIL, HOURS | 13.4 | 18.3 | 22.5 | 26.5 | 30.5 | 34.4 | 38.3 | 41.5 | 54.5 |
| FEED IDENTIFICATION, | 284 | 284 | 284 | 284 | 284 | 284 | 284 | 284 | 284 |
| OPERATING CONDITIONS | | | | | | | | | |
| PRESSURE, PSIG | 300.4 | 300.4 | 300.0 | 300.4 | 300.5 | 300.3 | 300.9 | 300.0 | 300.5 |
| RECYCLE GAS RATE, SCFB | 2890. | 2982. | 3022. | 3050. | 3091. | 3113. | 3030. | 3055. | 3037. |
| H2 PARTIAL PRESSURE, PSIA | 200.2 | 201.8 | 205.6 | 208.0 | 209.1 | 209.1 | 208.3 | 208.3 | 198.1 |
| HC PARTIAL PRESSURE, PSIA | 67.9 | 66.3 | 65.5 | 65.1 | 64.4 | 64.0 | 65.5 | 64.9 | 65.3 |
| H/HC RATIO | 2.95 | 3.05 | 3.14 | 3.20 | 3.25 | 3.27 | 3.18 | 3.21 | 3.03 |
| SPACE VELOCITY, WHSV | 4.045 | 3.989 | 4.000 | 3.998 | 3.975 | 3.954 | 4.024 | 4.037 | 3.987 |
| WT PERCENT RECOVERY | 98.83 | 100.28 | 100.38 | 100.00 | 100.22 | 102.47 | 99.08 | 98.92 | 100.41 |
| PRODUCT QUALITY | | | | | | | | | |
| C5+ RESEARCH OCTANE | 94.09 | 93.55 | 93.58 | 92.57 | 91.96 | 92.17 | 91.99 | 91.87 | 97.84 |
| C5+ GRAVITY, API | 45.07 | 45.23 | 45.30 | 45.72 | 46.01 | 45.74 | 45.91 | 46.13 | 42.44 |
| ACTIVITY DATA | | | | | | | | | |
| KINETIC AVG. TEMP., F. | 923.2 | 923.4 | 926.0 | 924.9 | 924.5 | 924.9 | 923.4 | 924.4 | 959.4 |
| YIELDS, VOL PERCENT ON FEED | | | | | | | | | |
| C5+ ULTRAFORMATE | 80.58 | 80.88 | 80.95 | 81.64 | 82.41 | 82.18 | 82.14 | 82.34 | 76.64 |
| C6+ ULTRAFORMATE | 74.42 | 74.56 | 74.41 | 75.41 | 77.25 | 76.44 | 76.29 | 76.48 | 69.91 |
| YIELDS, WT PERCENT ON FEED | | | | | | | | | |
| HYDROGEN | 1.83 | 1.82 | 1.77 | 1.73 | 1.73 | 1.72 | 1.75 | 1.73 | 1.99 |
| METHANE | 1.48 | 1.45 | 1.42 | 1.37 | 1.35 | 1.34 | 1.35 | 1.34 | 1.90 |
| ETHANE | 2.47 | 2.41 | 2.38 | 2.26 | 2.23 | 2.21 | 2.23 | 2.22 | 3.38 |
| PROPANE | 4.18 | 4.05 | 4.07 | 3.83 | 3.74 | 3.70 | 3.72 | 3.70 | 4.95 |
| ISO-BUTANE | 1.84 | 1.78 | 1.81 | 1.71 | 1.65 | 1.63 | 1.62 | 1.61 | 2.05 |
| NORMAL BUTANE | 3.01 | 3.05 | 3.07 | 3.09 | 2.63 | 2.84 | 2.88 | 2.86 | 3.47 |
| ISO-PENTANE | 3.11 | 3.18 | 3.30 | 3.16 | 2.55 | 2.88 | 2.94 | 2.94 | 3.28 |
| NORMAL PENTANE | 1.99 | 2.05 | 2.11 | 2.01 | 1.72 | 1.88 | 1.90 | 1.90 | 2.29 |
| C5+ ULTRAFORMATE | 85.20 | 85.44 | 85.48 | 86.01 | 86.68 | 86.57 | 86.44 | 86.54 | 82.26 |
| SATURATES (I-PARAFFINS INCLUDE UNIDENTIFIED NAPHTHENES) | | | | | | | | | |
| CP | 0.26 | 0.26 | 0.27 | 0.25 | 0.23 | 0.23 | 0.23 | 0.23 | 0.25 |
| IP6 | 2.94 | 3.00 | 3.01 | 2.93 | 2.77 | 2.84 | 2.84 | 2.82 | 3.15 |
| NP6 | 1.24 | 1.25 | 1.24 | 1.22 | 1.17 | 1.19 | 1.18 | 1.18 | 1.32 |
| IP7 | 3.99 | 4.06 | 4.07 | 4.09 | 4.09 | 4.07 | 4.07 | 4.05 | 3.29 |
| NP7 | 1.37 | 1.40 | 1.40 | 1.44 | 1.46 | 1.46 | 1.46 | 1.46 | 1.05 |
| IP8 | 6.72 | 6.94 | 6.86 | 7.46 | 7.71 | 7.65 | 7.68 | 7.69 | 3.92 |
| NP8 | 1.82 | 1.90 | 1.82 | 2.07 | 2.16 | 2.15 | 2.17 | 2.18 | 1.00 |
| P9+ | 5.37 | 6.01 | 6.18 | 7.08 | 7.55 | 7.56 | 7.73 | 7.86 | 2.45 |
| AROMATICS | | | | | | | | | |
| BENZENE | 0.41 | 0.41 | 0.40 | 0.37 | 0.35 | 0.35 | 0.34 | 0.34 | 0.60 |
| TOLUENE | 5.36 | 5.23 | 5.17 | 4.88 | 4.90 | 4.83 | 4.79 | 4.74 | 5.80 |
| TOTAL A8 | 15.63 | 15.36 | 15.26 | 14.94 | 15.11 | 14.92 | 14.75 | 14.70 | 16.98 |
| P + M XYLENE | 8.50 | 8.24 | 8.17 | 7.98 | 8.08 | 7.97 | 7.88 | 7.85 | 9.19 |
| O XYLENE | 3.82 | 3.83 | 3.79 | 3.70 | 3.74 | 3.69 | 3.64 | 3.63 | 4.20 |

TABLE II-continued

| AU43-180, PROCESSING CONDITIONS AND YIELDS | | | | | | | | | |
|---|---|---|---|---|---|---|---|---|---|
| A9+ | 35.03 | 34.38 | 34.42 | 34.15 | 34.90 | 34.56 | 34.36 | 34.48 | 36.86 |
| TOTAL | 56.43 | 55.38 | 55.25 | 54.34 | 55.26 | 54.67 | 54.24 | 54.26 | 60.25 |
| PERIOD NUMBER | 10 | 11 | 12 | 14 | 15 | 16 | 17 | 18 | 19 |
| PERIOD LENGTH, HOURS | 2.9 | 2.9 | 2.9 | 2.9 | 2.9 | 2.9 | 2.9 | 2.9 | 2.9 |
| TIME ON OIL, HOURS | 58.4 | 62.4 | 66.3 | 72.5 | 76.5 | 80.5 | 84.5 | 88.4 | 92.4 |
| FEED IDENTIFICATION, | 284 | 284 | 284 | 284 | 284 | 284 | 284 | 284 | 284 |
| OPERATING CONDITIONS | | | | | | | | | |
| PRESSURE, PSIG | 300.5 | 300.4 | 300.4 | 300.5 | 300.5 | 300.5 | 300.5 | 300.5 | 300.5 |
| RECYCLE GAS RATE, SCFB | 3032. | 3041. | 3045. | 3050. | 3062. | 3022. | 3040. | 3028. | 3044. |
| H2 PARTIAL PRESSURE, PSIA | 197.6 | 197.9 | 197.4 | 198.3 | 198.0 | 198.4 | 198.4 | 198.5 | 199.2 |
| HC PARTIAL PRESSURE, PSIA | 65.4 | 65.2 | 65.2 | 65.1 | 64.9 | 65.6 | 65.3 | 65.5 | 65.2 |
| H/HC RATIO | 3.02 | 3.03 | 3.03 | 3.05 | 3.05 | 3.03 | 3.04 | 3.03 | 3.06 |
| SPACE VELOCITY, WHSV | 4.010 | 4.014 | 4.013 | 4.008 | 3.996 | 4.008 | 4.009 | 4.011 | 4.010 |
| WT PERCENT RECOVERY | 100.58 | 100.28 | 99.89 | 99.55 | 100.29 | 100.39 | 100.48 | 99.82 | 99.71 |
| PRODUCT QUALITY | | | | | | | | | |
| C5+ RESEARCH OCTANE | 97.73 | 97.68 | 97.48 | 97.03 | 96.82 | 96.67 | 96.58 | 96.56 | 96.44 |
| C5+ GRAVITY, API | 42.49 | 42.34 | 42.56 | 43.11 | 43.21 | 43.28 | 43.30 | 43.30 | 43.36 |
| ACTIVITY DATA | | | | | | | | | |
| KINETIC AVG. TEMP., F. | 960.2 | 960.5 | 960.9 | 961.0 | 960.2 | 960.3 | 960.7 | 961.0 | 960.9 |
| YIELDS, VOL PERCENT ON FEED | | | | | | | | | |
| C5+ ULTRAFORMATE | 76.71 | 76.77 | 77.04 | 77.65 | 77.82 | 77.83 | 77.76 | 77.91 | 78.21 |
| C6+ ULTRAFORMATE | 69.81 | 69.95 | 70.20 | 70.99 | 71.17 | 71.13 | 71.11 | 71.31 | 72.42 |
| YIELDS, WT PERCENT ON FEED | | | | | | | | | |
| HYDROGEN | 1.96 | 1.94 | 1.93 | 1.91 | 1.90 | 1.91 | 1.88 | 1.87 | 1.87 |
| METHANE | 1.87 | 1.85 | 1.84 | 1.78 | 1.77 | 1.78 | 1.78 | 1.75 | 1.74 |
| ETHANE | 3.35 | 3.33 | 3.31 | 3.21 | 3.18 | 3.20 | 3.19 | 3.18 | 3.14 |
| PROPANE | 4.93 | 4.89 | 4.82 | 4.71 | 4.67 | 4.66 | 4.70 | 4.67 | 4.59 |
| ISO-BUTANE | 2.04 | 2.02 | 1.99 | 1.96 | 1.94 | 1.93 | 1.95 | 1.93 | 1.91 |
| NORMAL BUTANE | 3.54 | 3.52 | 3.48 | 3.40 | 3.38 | 3.40 | 3.44 | 3.38 | 3.26 |
| ISO-PENTANE | 3.36 | 3.32 | 3.32 | 3.22 | 3.22 | 3.24 | 3.21 | 3.18 | 2.79 |
| NORMAL PENTANE | 2.34 | 2.33 | 2.34 | 2.29 | 2.29 | 2.30 | 2.29 | 2.28 | 2.01 |
| C5+ ULTRAFORMATE | 82.31 | 82.45 | 82.63 | 83.03 | 83.16 | 83.13 | 83.05 | 83.21 | 83.51 |
| SATURATES (I-PARAFFINS INCLUDE UNIDENTIFIED NAPHTHENES) | | | | | | | | | |
| CP | 0.25 | 0.25 | 0.24 | 0.23 | 0.23 | 0.23 | 0.22 | 0.22 | 0.19 |
| IP6 | 3.20 | 3.21 | 3.20 | 3.17 | 3.17 | 3.19 | 3.16 | 3.04 | 2.70 |
| NP6 | 1.36 | 1.35 | 1.36 | 1.36 | 1.33 | 1.35 | 1.34 | 1.30 | 1.17 |
| IP7 | 3.36 | 3.41 | 3.41 | 3.45 | 3.48 | 3.51 | 3.51 | 3.50 | 3.37 |
| NP7 | 1.08 | 1.11 | 1.11 | 1.14 | 1.16 | 1.17 | 1.18 | 1.18 | 1.16 |
| IP8 | 4.08 | 4.22 | 4.29 | 4.47 | 4.62 | 4.72 | 4.79 | 4.87 | 4.97 |
| NP8 | 1.04 | 1.09 | 1.12 | 1.18 | 1.23 | 1.26 | 1.32 | 1.35 | 1.39 |
| P9+ | 2.43 | 2.60 | 2.79 | 3.17 | 3.43 | 3.54 | 3.65 | 3.90 | 4.18 |
| AROMATICS | | | | | | | | | |
| BENZENE | 0.60 | 0.60 | 0.58 | 0.57 | 0.54 | 0.54 | 0.54 | 0.53 | 0.48 |
| TOLUENE | 5.82 | 5.80 | 5.76 | 5.68 | 5.58 | 5.58 | 5.56 | 5.57 | 5.47 |
| TOTAL A8 | 16.96 | 16.92 | 16.88 | 16.77 | 16.60 | 16.54 | 16.46 | 16.48 | 16.71 |
| P + M XYLENE | 9.20 | 9.17 | 9.13 | 9.09 | 8.99 | 8.95 | 8.93 | 8.92 | 9.05 |
| O XYLENE | 4.18 | 4.16 | 4.14 | 4.11 | 4.05 | 4.03 | 4.00 | 4.01 | 4.06 |
| A9+ | 36.39 | 36.23 | 36.20 | 36.31 | 36.28 | 35.93 | 35.80 | 35.79 | 36.89 |
| TOTAL | 59.76 | 59.54 | 59.42 | 59.34 | 59.00 | 58.59 | 58.37 | 58.37 | 59.55 |

TABLE III

| AU43-183, PROCESSING CONDITIONS AND YIELDS | | | | | | | | |
|---|---|---|---|---|---|---|---|---|
| PERIOD NUMBER | 1 | 2 | 3 | 4 | 5 | 6 | 7 | 8 |
| PERIOD LENGTH, HOURS | 2.9 | 2.9 | 2.9 | 2.9 | 2.9 | 2.9 | 2.9 | 2.9 |
| TIME ON OIL, HOURS | 14.9 | 22.9 | 30.9 | 38.8 | 46.8 | 54.8 | 62.8 | 70.7 |
| FEED IDENTIFICATION, | 274 | 274 | 274 | 274 | 274 | 274 | 274 | 274 |
| OPERATING CONDITIONS | | | | | | | | |
| PRESSURE, PSIG | 300.6 | 300.6 | 300.5 | 300.5 | 300.5 | 300.5 | 300.5 | 300.5 |
| RECYCLE GAS RATE, SCFB | 4175. | 4153. | 4120. | 4178. | 4242. | 4240. | 4177. | 4211. |
| H2 PARTIAL PRESSURE, PSIA | 226.2 | 226.3 | 226.2 | 226.4 | 227.8 | 228.6 | 227.5 | 227.5 |
| HC PARTIAL PRESSURE, PSIA | 53.7 | 53.9 | 54.3 | 53.6 | 53.0 | 53.0 | 53.6 | 53.3 |
| H/HC RATIO | 4.22 | 4.20 | 4.17 | 4.23 | 4.31 | 4.32 | 4.25 | 4.28 |
| SPACE VELOCITY, WHSV | 2.727 | 2.738 | 2.737 | 2.736 | 2.737 | 2.730 | 2.732 | 2.714 |
| WT PERCENT RECOVERY | 98.61 | 99.83 | 100.15 | 98.58 | 98.59 | 99.90 | 100.07 | 99.29 |
| PRODUCT QUALITY | | | | | | | | |
| C5+ RESEARCH OCTANE | 97.25 | 96.88 | 96.23 | 95.88 | 95.70 | 95.61 | 95.64 | 95.56 |
| C5+ GRAVITY, API | 44.45 | 44.46 | 44.94 | 45.13 | 45.14 | 45.33 | 45.13 | 45.45 |
| ACTIVITY DATA | | | | | | | | |
| KINETIC AVG. TEMP., F. | 925.2 | 925.1 | 925.4 | 926.1 | 925.0 | 925.8 | 926.1 | 926.1 |
| YIELDS, VOL PERCENT ON FEED | | | | | | | | |
| C5+ ULTRAFORMATE | 81.29 | 81.50 | 81.71 | 82.02 | 82.34 | 82.52 | 82.43 | 82.55 |
| C6+ ULTRAFORMATE | 75.40 | 75.66 | 76.06 | 76.30 | 76.84 | 77.41 | 76.97 | 77.06 |
| YIELDS, WT PERCENT ON FEED | | | | | | | | |
| HYDROGEN | 2.33 | 2.28 | 2.28 | 2.27 | 2.24 | 2.21 | 2.23 | 2.22 |

TABLE III-continued

AU43-183, PROCESSING CONDITIONS AND YIELDS

| | | | | | | | | |
|---|---|---|---|---|---|---|---|---|
| METHANE | 1.71 | 1.69 | 1.67 | 1.67 | 1.63 | 1.60 | 1.60 | 1.67 |
| ETHANE | 2.47 | 2.46 | 2.48 | 2.43 | 2.37 | 2.34 | 2.35 | 2.37 |
| PROPANE | 3.13 | 3.06 | 3.06 | 2.98 | 2.89 | 2.88 | 2.87 | 2.86 |
| ISO-BUTANE | 1.65 | 1.60 | 1.60 | 1.55 | 1.49 | 1.48 | 1.46 | 1.46 |
| NORMAL BUTANE | 2.18 | 2.14 | 2.17 | 2.11 | 2.06 | 2.07 | 2.06 | 2.05 |
| ISO-PENTANE | 3.00 | 2.99 | 2.87 | 2.91 | 2.78 | 2.57 | 2.74 | 2.76 |
| NORMAL PENTANE | 1.88 | 1.86 | 1.82 | 1.85 | 1.79 | 1.68 | 1.80 | 1.80 |
| C5+ ULTRAFORMATE | 86.54 | 86.77 | 86.75 | 86.99 | 87.32 | 87.42 | 87.42 | 87.38 |
| SATURATES (I-PARAFFINS INCLUDE UNIDENTIFIED NAPHTHENES) | | | | | | | | |
| CP | 0.48 | 0.46 | 0.44 | 0.43 | 0.42 | 0.40 | 0.41 | 0.41 |
| IP6 | 5.04 | 5.04 | 5.01 | 5.08 | 5.04 | 4.94 | 5.04 | 5.08 |
| NP6 | 2.29 | 2.31 | 2.31 | 2.37 | 2.37 | 2.36 | 2.41 | 2.43 |
| IP7 | 5.95 | 6.00 | 6.07 | 6.19 | 6.30 | 6.39 | 6.44 | 6.47 |
| NP7 | 1.71 | 1.74 | 1.79 | 1.83 | 1.88 | 1.92 | 1.93 | 1.95 |
| IP8 | 3.87 | 4.02 | 4.17 | 4.31 | 4.49 | 4.63 | 4.65 | 4.68 |
| NP8 | 0.76 | 0.81 | 0.84 | 0.87 | 0.92 | 0.95 | 0.95 | 0.96 |
| P9+ | 1.67 | 1.87 | 2.07 | 2.28 | 2.56 | 2.69 | 2.76 | 2.79 |
| AROMATICS | | | | | | | | |
| BENZENE | 2.98 | 2.93 | 2.88 | 2.86 | 2.80 | 2.77 | 2.78 | 2.76 |
| TOLUENE | 13.52 | 13.38 | 13.29 | 13.15 | 13.06 | 13.06 | 12.93 | 12.88 |
| TOTAL A8 | 18.60 | 18.53 | 18.43 | 18.21 | 18.20 | 18.22 | 17.97 | 17.92 |
| P + M XYLENE | 11.03 | 10.91 | 10.85 | 10.74 | 10.75 | 10.77 | 10.64 | 10.60 |
| O XYLENE | 4.23 | 4.25 | 4.20 | 4.14 | 4.12 | 4.11 | 4.05 | 4.04 |
| A9+ | 24.85 | 24.87 | 24.81 | 24.68 | 24.76 | 24.90 | 24.65 | 24.54 |
| TOTAL | 59.94 | 59.71 | 59.41 | 58.90 | 58.82 | 58.94 | 58.33 | 58.11 |
| PERIOD NUMBER | 9 | 10 | 11 | 12 | 13 | 14 | 15 | 16 |
| PERIOD LENGTH, HOURS | 3.9 | 3.9 | 3.9 | 4.0 | 3.9 | 3.0 | 2.9 | 2.9 |
| TIME ON OIL, HOURS | 82.5 | 87.5 | 92.5 | 97.5 | 102.4 | 107.0 | 111.0 | 115.0 |
| FEED IDENTIFICATION, | 284 | 284 | 284 | 284 | 284 | 284 | 284 | 284 |
| OPERATING CONDITIONS | | | | | | | | |
| PRESURE, PSIG | 300.6 | 300.6 | 300.6 | 300.6 | 300.6 | 300.6 | 300.6 | 300.6 |
| RECYCLE GAS RATE, SCFB | 4016. | 4037. | 4066. | 4101. | 3955. | 3945. | 3950. | 3933. |
| H2 PARTIAL PRESSURE, PSIA | 213.0 | 214.5 | 213.7 | 211.3 | 208.7 | 207.9 | 207.9 | 208.0 |
| HC PARTIAL PRESSURE, PSIA | 52.0 | 51.8 | 51.5 | 51.1 | 52.7 | 52.8 | 52.8 | 53.0 |
| H/HC RATIO | 4.09 | 4.14 | 4.15 | 4.13 | 3.96 | 3.94 | 3.94 | 3.93 |
| SPACE VELOCITY, WHSV | 2.425 | 2.407 | 2.408 | 2.382 | 2.402 | 2.409 | 2.408 | 2.414 |
| WT PERCENT RECOVERY | 98.95 | 99.46 | 99.17 | 98.21 | 99.00 | 99.05 | 98.76 | 98.85 |
| PRODUCT QUALITY | | | | | | | | |
| C5+ RESEARCH OCTANE | 99.37 | 99.37 | 99.60 | 99.68 | 100.06 | 99.88 | 99.58 | 99.54 |
| C5+ GRAVITY, API | 41.62 | 41.68 | 41.29 | 41.51 | 41.16 | 41.27 | 41.67 | 41.66 |
| ACTIVITY DATA | | | | | | | | |
| KINETIC AVG. TEMP., F | 949.2 | 950.3 | 952.3 | 952.3 | 952.8 | 953.5 | 951.1 | 951.0 |
| YIELDS, VOL PERCENT ON FEED | | | | | | | | |
| C5+ ULTRAFORMATE | 75.66 | 75.71 | 75.12 | 74.73 | 74.10 | 74.25 | 74.06 | 74.25 |
| C6+ ULTRAFORMATE | 68.28 | 68.46 | 67.68 | 66.85 | 66.10 | 66.29 | 66.19 | 66.25 |
| YIELDS, WT PERCENT ON FEED | | | | | | | | |
| HYDROGEN | 2.10 | 2.09 | 2.05 | 2.11 | 2.05 | 2.03 | 1.98 | 1.96 |
| METHANE | 2.12 | 2.03 | 2.08 | 2.14 | 2.23 | 2.24 | 2.30 | 2.28 |
| ETHANE | 3.71 | 3.62 | 3.68 | 3.78 | 3.94 | 3.95 | 4.06 | 4.02 |
| PROPANE | 4.77 | 4.84 | 5.02 | 5.15 | 5.33 | 5.30 | 5.45 | 5.40 |
| ISO-BUTANE | 2.21 | 2.27 | 2.37 | 2.43 | 2.51 | 2.48 | 2.45 | 2.42 |
| NORMAL BUTANE | 3.49 | 3.53 | 3.63 | 3.73 | 3.82 | 3.76 | 3.92 | 3.88 |
| ISO-PENTANE | 3.66 | 3.62 | 3.69 | 3.93 | 3.94 | 3.92 | 3.87 | 3.93 |
| NORMAL PENTANE | 2.45 | 2.37 | 2.47 | 2.60 | 2.68 | 2.66 | 2.64 | 2.69 |
| C5+ ULTRAFORMATE | 81.60 | 81.62 | 81.17 | 80.64 | 80.13 | 80.24 | 79.84 | 80.06 |
| SATURATES (I-PARAFFINS INCLUDE UNIDENTIFIED NAPHTHENES) | | | | | | | | |
| CP | 0.25 | 0.25 | 0.25 | 0.25 | 0.23 | 0.22 | 0.21 | 0.21 |
| IP6 | 3.51 | 3.43 | 3.51 | 3.56 | 3.42 | 3.51 | 3.54 | 3.58 |
| NP6 | 1.43 | 1.38 | 1.42 | 1.44 | 1.40 | 1.43 | 1.45 | 1.46 |
| IP7 | 3.19 | 3.20 | 3.13 | 2.99 | 2.84 | 2.84 | 2.92 | 2.99 |
| NP7 | 0.91 | 0.91 | 0.88 | 0.84 | 0.80 | 0.80 | 0.83 | 0.85 |
| IP8 | 3.22 | 3.21 | 2.99 | 2.73 | 2.60 | 2.59 | 2.74 | 2.91 |
| NP8 | 0.65 | 0.64 | 0.59 | 0.53 | 0.50 | 0.51 | 0.53 | 0.57 |
| P9+ | 1.07 | 1.07 | 0.94 | 0.81 | 0.75 | 0.74 | 0.84 | 0.91 |
| AROMATICS | | | | | | | | |
| BENZENE | 0.75 | 0.73 | 0.80 | 0.84 | 0.83 | 0.84 | 0.83 | 0.81 |
| TOLUENE | 7.05 | 6.99 | 7.23 | 7.36 | 7.38 | 7.37 | 7.06 | 7.23 |
| TOTAL A8 | 19.10 | 19.10 | 19.20 | 19.20 | 19.26 | 19.17 | 19.01 | 18.76 |
| P + M XYLENE | 10.80 | 10.80 | 10.88 | 10.91 | 10.96 | 10.91 | 10.82 | 10.67 |
| O XYLENE | 4.49 | 4.51 | 4.51 | 4.49 | 4.48 | 4.45 | 4.41 | 4.34 |
| A9+ | 34.37 | 34.72 | 34.05 | 33.58 | 33.53 | 33.59 | 33.36 | 33.16 |
| TOTAL | 61.27 | 61.55 | 61.28 | 60.97 | 61.00 | 60.98 | 60.26 | 59.96 |
| PERIOD NUMBER | 17 | 18 | 19 | 20 | 21 | 22 | 23 | 24 |
| PERIOD LENGTH, HOURS | 2.9 | 2.9 | 2.9 | 2.9 | 2.9 | 2.9 | 2.9 | 1.9 |
| TIME ON OIL, HOURS | 119.0 | 126.0 | 130.1 | 134.0 | 139.9 | 144.0 | 148.0 | 151.5 |
| FEED IDENTIFICATION, | 284 | 284 | 284 | 284 | 274 | 274 | 274 | 274 |

TABLE III-continued

| AU43-183, PROCESSING CONDITIONS AND YIELDS | | | | | | | | |
|---|---|---|---|---|---|---|---|---|
| OPERATING CONDITIONS | | | | | | | | |
| PRESSURE, PSIG | 300.6 | 300.6 | 300.6 | 300.6 | 300.6 | 300.6 | 300.6 | 300.6 |
| RECYCLE GAS RATE, SCFB | 3930. | 3983. | 3763. | 3725. | 4378. | 4196. | 3961. | 3949. |
| H2 PARTIAL PRESSURE, PSIA | 207.5 | 207.9 | 205.9 | 205.6 | 223.8 | 215.7 | 216.7 | 216.3 |
| HC PARTIAL PRESSURE, PSIA | 53.0 | 52.4 | 54.9 | 55.4 | 51.6 | 53.5 | 56.1 | 56.2 |
| H/HC RATIO | 3.92 | 3.97 | 3.75 | 3.71 | 4.34 | 4.04 | 3.87 | 3.85 |
| SPACE VELOCITY, WHSV | 2.415 | 2.414 | 2.507 | 2.518 | 2.589 | 2.617 | 2.701 | 2.694 |
| WT PERCENT RECOVERY | 100.01 | 98.50 | 99.05 | 99.43 | 99.84 | 100.33 | 99.83 | 98.64 |
| PRODUCT QUALITY | | | | | | | | |
| C5+ RESEARCH OCTANE | 99.41 | 93.39 | 93.45 | 94.10 | 95.96 | 96.03 | 96.02 | 95.86 |
| C5+ GRAVITY, API | 41.86 | 45.99 | 46.46 | 45.83 | 45.35 | 45.55 | 45.41 | 45.62 |
| ACTIVITY DATA | | | | | | | | |
| KINETIC AVG. TEMP., F. | 951.5 | 919.6 | 921.7 | 922.3 | 935.7 | 933.6 | 935.0 | 934.6 |
| YIELDS, VOL PERCENT ON FEED | | | | | | | | |
| C5+ ULTRAFORMATE | 74.54 | 80.61 | 78.06 | 77.18 | 80.59 | 80.74 | 81.00 | 80.97 |
| C6+ ULTRAFORMATE | 66.68 | 74.19 | 71.43 | 70.58 | 74.29 | 74.24 | 74.67 | 74.73 |
| YIELDS, WT PERCENT ON FEED | | | | | | | | |
| HYDROGEN | 1.95 | 1.66 | 1.97 | 2.01 | 1.96 | 1.96 | 1.97 | 1.97 |
| METHANE | 2.21 | 1.61 | 1.88 | 1.92 | 1.98 | 1.97 | 1.82 | 1.78 |
| ETHANE | 3.93 | 2.81 | 3.30 | 3.40 | 2.79 | 2.78 | 2.75 | 2.81 |
| PROPANE | 5.28 | 4.05 | 4.86 | 5.05 | 3.52 | 3.51 | 3.44 | 3.49 |
| ISO-BUTANE | 2.50 | 1.94 | 2.35 | 2.45 | 1.86 | 1.85 | 1.80 | 1.82 |
| NORMAL BUTANE | 3.84 | 3.13 | 3.74 | 3.91 | 2.52 | 2.51 | 2.45 | 2.49 |
| ISO-PENTANE | 3.87 | 3.23 | 3.39 | 3.36 | 3.13 | 3.22 | 3.12 | 3.10 |
| NORMAL PENTANE | 2.64 | 2.08 | 2.10 | 2.10 | 2.11 | 2.18 | 2.13 | 2.09 |
| C5+ ULTRAFORMATE | 80.28 | 84.79 | 81.89 | 81.26 | 85.37 | 85.43 | 85.77 | 85.64 |
| SATURATES (I-PARAFFINS INCLUDE UNIDENTIFIED NAPHTHENES) | | | | | | | | |
| CP | 0.21 | 0.19 | 0.19 | 0.19 | 0.32 | 0.33 | 0.33 | 0.32 |
| IP6 | 3.58 | 3.37 | 3.46 | 3.40 | 5.16 | 5.37 | 5.47 | 5.33 |
| NP6 | 1.47 | 1.37 | 1.38 | 1.35 | 2.37 | 2.47 | 2.53 | 2.46 |
| IP7 | 3.01 | 4.31 | 4.18 | 4.06 | 5.88 | 5.96 | 6.04 | 5.95 |
| NP7 | 0.86 | 1.34 | 1.29 | 1.24 | 1.75 | 1.76 | 1.78 | 1.77 |
| IP8 | 2.95 | 7.45 | 7.00 | 6.71 | 4.21 | 4.04 | 4.03 | 4.11 |
| NP8 | 0.58 | 1.66 | 1.54 | 1.47 | 0.83 | 0.79 | 0.78 | 0.81 |
| P9+ | 0.95 | 6.03 | 5.47 | 5.17 | 2.32 | 2.04 | 1.99 | 2.14 |
| AROMATICS | | | | | | | | |
| BENZENE | 0.81 | 0.43 | 0.43 | 0.42 | 2.71 | 2.83 | 2.87 | 2.73 |
| TOLUENE | 7.25 | 5.51 | 5.34 | 5.33 | 12.58 | 12.95 | 13.11 | 12.78 |
| TOTAL A8 | 18.82 | 15.74 | 15.24 | 15.32 | 17.73 | 17.84 | 17.95 | 17.93 |
| P + M XYLENE | 10.71 | 8.76 | 8.48 | 8.54 | 10.50 | 10.65 | 10.71 | 10.70 |
| O XYLENE | 4.35 | 3.63 | 3.51 | 3.54 | 3.96 | 3.96 | 3.98 | 3.97 |
| A9+ | 33.27 | 32.08 | 30.88 | 31.15 | 24.30 | 23.67 | 23.64 | 24.15 |
| TOTAL | 60.15 | 53.76 | 51.89 | 52.22 | 57.32 | 57.30 | 57.56 | 57.58 |

I claim as my invention:

1. In a catalytic reforming process for conversion of a naphtha hydrocarbon at reforming conditions having at least two segregated catalyst zones, an improvement which comprises contacting the hydrocarbon in a first zone with a first catalyst comprising tin and at least one platinum group metal deposited on a solid catalyst support followed by contacting in a second zone with a second catalyst comprising at least one metal selected from the group consisting of platinum group metals deposited on a solid catalyst support.

2. The process of claim 1 further characterized in that said solid catalyst supports contain a catalytically effective amount of a halogen component.

3. The process of claim 1 further characterized in that said first catalyst contains platinum.

4. The process of claim 1 further characterized in that said second catalyst contains platinum.

5. The process of claim 1 further characterized in that said second catalyst contains platinum and rhenium.

6. The process of claim 2 further characterized in that each of said solid catalyst supports contain a halogen component in an amount, on an elemental basis, of from about 0.1 to about 3.5 weight percent of the respective catalysts.

7. The process of claim 1 further characterized in that said first catalyst contains, on an elemental basis, from about 0.05 to about 1 weight percent platinum, about 0.05 to about 1 weight percent tin and about 0.5 to about 1.5 weight percent halogen and the second catalyst contains, on an elemental basis, from about 0.05 to about 1 weight percent platinum and about 0.5 to about 1.5 weight percent halogen.

8. The process of claim 7 further characterized in that said second catalyst contains from about 0.05 to about 1 weight percent rhenium on an elemental basis.

9. The process of claim 1 further characterized in that said second catalyst has an essential absence of tin.

10. The process of claim 9 further characterized in that said second catalyst contains less than about 0.05 weight percent tin on an elemental basis.

11. In a catalytic reforming process for conversion of a naphtha hydrocarbon at reforming conditions having initial, intermediate and terminal reaction sections for sequential conversion of a hydrocarbon stream and wherein each section contains at least one segregated catalyst zone containing a reforming catalyst wherein an improvement comprises maintaining a sequence of a first catalyst followed by a second catalyst wherein the first catalyst comprises tin and at least one metal selected from the platinum group metals deposited on a solid catalyst support and wherein the second catalyst has an essential absence of tin and comprises at least one metal selected from the group consisting of platinum group metals deposited on a solid catalyst support.

12. The process of claim 11 further characterized in that said first catalyst is contained in the intermediate reaction section and said second catalyst is contained in the terminal reaction section.

13. The process of claim 12 further characterized in that said first catalyst is also contained in the initial reaction section.

14. The process of claim 11 further characterized in that said first catalyst is contained in the initial reaction section and said second catalyst is contained in the intermediate reaction section.

15. The process of claim 14 further characterized in that said second catalyst is also contained in the terminal reaction section.

16. The process of claim 11 further characterized in that said second catalyst contains less than about 0.05 weight percent tin on an elemental basis.

17. The process of claim 11 further characterized in that said first catalyst contains, on an elemental basis, from about 0.05 to about 1 weight percent platinum, about 0.05 to about 1 weight percent tin and about 0.5 to about 1.5 weight percent halogen and the second catalyst contains, on an elemental basis, from about 0.05 to about 1 weight percent platinum and from about 0.5 to about 1.5 weight percent halogen.

18. The process of claim 17 further characterized in that said second catalyst contains from about 0.05 to about 1 weight percent rhenium on an elemental basis.

19. The process of claim 11 further characterized in that said initial reaction section comprises a fixed-bed reaction zone, said intermediate reaction section comprises two separate fixed-bed reaction zones, said terminal reaction section comprises two separate fixed-bed reaction zones and wherein said first catalyst is maintained throughout the intermediate reaction section and said second catalyst is maintained in at least one fixed-bed reaction zone in the terminal reaction section.

20. The process of claim 19 further characterized in that said first catalyst contains, on an elemental basis, from about 0.05 to about 1 weight percent platinum, about 0.05 to about 1 weight percent tin and about 0.5 to about 1.5 weight percent halogen and the second catalyst contains, on an elemental basis, from about 0.05 to about 1 weight percent platinum and about 0.5 to about 1.5 weight percent halogen.

21. The process of claim 20 further characterized in that said initial reaction section contains a catalyst comprising at least one platinum group metal on a solid catalyst support.

* * * * *